US008156730B2

(12) United States Patent
Guo et al.

(10) Patent No.: US 8,156,730 B2
(45) Date of Patent: Apr. 17, 2012

(54) ENGINE PERFORMANCE MANAGEMENT DURING A DIESEL PARTICULATE FILTER REGENERATION EVENT

(75) Inventors: Linsong Guo, Columbus, IN (US); Timothy R. Frazier, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 1023 days.

(21) Appl. No.: 12/111,845

(22) Filed: Apr. 29, 2008

(65) Prior Publication Data

US 2009/0266060 A1 Oct. 29, 2009

(51) Int. Cl.
*F01N 5/04* (2006.01)
*F01N 3/00* (2006.01)

(52) U.S. Cl. ..... 60/280; 60/285; 60/286; 60/295

(58) Field of Classification Search ..... 60/280
See application file for complete search history.

(56) References Cited

U.S. PATENT DOCUMENTS

| | | | | |
|---|---|---|---|---|
| 5,398,502 | A | 3/1995 | Watanabe | |
| 6,304,815 | B1 * | 10/2001 | Moraal et al. | 701/115 |
| 6,382,177 | B1 | 5/2002 | Saito | |
| 6,408,834 | B1 | 6/2002 | Brackney et al. | |
| 6,519,933 | B2 | 2/2003 | Ogiso et al. | |
| 6,594,990 | B2 * | 7/2003 | Kuenstler et al. | 60/295 |
| 6,606,979 | B2 | 8/2003 | Kimura | |
| 6,666,020 | B2 * | 12/2003 | Tonetti et al. | 60/286 |
| 6,729,128 | B2 | 5/2004 | Shiratani et al. | |
| 6,738,702 | B2 | 5/2004 | Kolmanovsky et al. | |
| 6,802,180 | B2 * | 10/2004 | Gabe et al. | 60/285 |
| 6,826,905 | B2 | 12/2004 | Gui et al. | |
| 6,829,890 | B2 | 12/2004 | Gui et al. | |
| 6,862,881 | B1 | 3/2005 | Klingbeil et al. | |
| 6,925,802 | B2 | 8/2005 | Arnold | |
| 6,925,976 | B2 | 8/2005 | Israel et al. | |

(Continued)

FOREIGN PATENT DOCUMENTS

EP 1270884 A1 1/2003

(Continued)

OTHER PUBLICATIONS

PCT/US2009/045847, International Search Report and Written Opinion, Jan. 18, 2010.

(Continued)

*Primary Examiner* — Thomas Denion
*Assistant Examiner* — Jason Shanske
(74) *Attorney, Agent, or Firm* — Kunzler Needham Massey & Thorpe

(57) ABSTRACT

Various embodiments of an apparatus, system, and method are disclosed for managing regeneration event characteristics. For example, according to one embodiment, an apparatus for controlling the temperature of the output exhaust of an internal combustion engine for a regeneration event on a particulate matter filter includes a regeneration module, a turbocharger thermal management module, a fuel injection thermal management module, and an air intake thermal management module. The regeneration module determines a desired particulate matter filter inlet exhaust gas temperature for a regeneration event. The turbocharger thermal management module determines a variable geometry turbine (VGT) device position strategy. The fuel injection thermal management module determines a fuel injection strategy. The air intake thermal management module determines an intake throttle position strategy. The VGT device position strategy, the post-injection fuel injection strategy, and the intake throttle position strategy cooperatively achieve the desired particulate matter filter inlet exhaust gas temperature and maintain a fuel dilution level of the engine below a maximum fuel dilution level.

20 Claims, 11 Drawing Sheets

U.S. PATENT DOCUMENTS

| | | | | |
|---|---|---|---|---|
| 6,948,476 | B2 | 9/2005 | Gioannini et al. | |
| 6,951,100 | B2 | 10/2005 | Kuboshima et al. | |
| 6,952,918 | B2 | 10/2005 | Imai et al. | |
| 6,952,919 | B2 * | 10/2005 | Otake et al. | 60/297 |
| 6,959,541 | B2 | 11/2005 | Kosaka et al. | |
| 6,978,603 | B2 | 12/2005 | Asanuma | |
| 6,978,604 | B2 | 12/2005 | Wang et al. | |
| 6,988,361 | B2 | 1/2006 | van Nieuwstadt et al. | |
| 7,044,118 | B2 | 5/2006 | Tonetti et al. | |
| 7,086,220 | B2 | 8/2006 | Imai et al. | |
| 7,155,334 | B1 | 12/2006 | Stewart et al. | |
| 7,156,062 | B2 | 1/2007 | Vanderpoel | |
| 7,178,331 | B2 | 2/2007 | Blakeman et al. | |
| 7,246,595 | B1 | 7/2007 | Hoare et al. | |
| 7,261,086 | B2 * | 8/2007 | Nuang | 123/436 |
| 7,421,837 | B2 | 9/2008 | Abe | |
| 7,469,533 | B2 | 12/2008 | Dawson et al. | |
| 7,657,364 | B2 | 2/2010 | Guo | |
| 2004/0055282 | A1 | 3/2004 | Gray et al. | |
| 2004/0244366 | A1 | 12/2004 | Hiranuma et al. | |
| 2005/0154519 | A1 | 7/2005 | Kim | |
| 2005/0223699 | A1 | 10/2005 | Ancimer et al. | |
| 2005/0235953 | A1 | 10/2005 | Weber et al. | |
| 2005/0241597 | A1 | 11/2005 | Weber et al. | |
| 2006/0242950 | A1 | 11/2006 | Wang et al. | |
| 2006/0283421 | A1 * | 12/2006 | Chiba et al. | 123/299 |
| 2007/0214772 | A1 | 9/2007 | England | |
| 2008/0010975 | A1 | 1/2008 | Zhang et al. | |
| 2008/0078169 | A1 | 4/2008 | Ishibashi | |
| 2009/0198429 | A1 | 8/2009 | Farrell et al. | |
| 2009/0293453 | A1 | 12/2009 | Sujan | |

FOREIGN PATENT DOCUMENTS

| | | | |
|---|---|---|---|
| EP | 1344897 | A1 | 9/2003 |
| EP | 1598526 | A2 | 11/2005 |
| EP | 1662101 | A1 | 5/2006 |
| EP | 1676991 | A2 | 7/2006 |
| KR | 10-2005-0070572 | | 7/2005 |
| KR | 100589168 | B1 | 6/2006 |

OTHER PUBLICATIONS

PCT/US2009/031015 International Search Report and Written Opinion, Aug. 13, 2009.

PCT/US2009/033423 International Search Report and Written Opinion, Jul. 28, 2009.

How does Variable Turbine Geometry Work?, http://paultan.org/archives/2006/08/16/how-does-variable-turbine-geometry-work/ Mar. 27, 2008.

Turbocharging, http://www.autozine.org/technical_school/engine/tech_engine_3.htm Mar. 27, 2008.

PCT/US2009/042121, International Search Results and Written Opinion, Dec. 1, 2009.

* cited by examiner

ENGINE PERFORMANCE MANAGEMENT DURING A DIESEL PARTICULATE FILTER REGENERATION EVENT

FIELD

This disclosure relates to controlling regeneration events on a diesel particulate filter (DPF) of an internal combustion engine system, and more particularly to the management of engine performance during a DPF regeneration event.

BACKGROUND

Emissions regulations for internal combustion engines have become more stringent over recent years. Environmental concerns have motivated the implementation of stricter emission requirements for internal combustion engines throughout much of the world. Governmental agencies, such as the Environmental Protection Agency (EPA) in the United States, carefully monitor the emission quality of engines and set acceptable emission standards, to which all engines must comply. Generally, emission requirements vary according to engine type. Emission tests for compression-ignition (diesel) engines typically monitor the release of diesel particulate matter (PM), nitrogen oxides ($NO_x$), and unburned hydrocarbons (UHC). Catalytic converters implemented in an exhaust gas after-treatment system have been used to eliminate many of the pollutants present in exhaust gas. However, to remove diesel particulate matter, typically a diesel particulate filter (DPF) must be installed downstream from a catalytic converter, or in conjunction with a catalytic converter.

A common DPF comprises a porous ceramic matrix with parallel passageways through which exhaust gas passes. Particulate matter subsequently accumulates on the surface of the filter, creating a buildup which must eventually be removed to prevent obstruction of the exhaust gas flow. Common forms of particulate matter are ash and soot. Ash, typically a residue of burnt engine oil, is substantially incombustible and builds slowly within the filter. Soot, chiefly composed of carbon, results from incomplete combustion of fuel and generally comprises a large percentage of particulate matter buildup. Various conditions, including, but not limited to, engine operating conditions, mileage, driving style, terrain, etc., affect the rate at which particulate matter accumulates within a diesel particulate filter.

Accumulation of particulate matter typically causes backpressure within the exhaust system. Excessive backpressure on the engine can degrade engine performance. Particulate matter, in general, oxidizes in the presence of $NO_2$ at modest temperatures, or in the presence of oxygen at higher temperatures. If too much particulate matter has accumulated when oxidation begins, the oxidation rate may get high enough to cause an uncontrolled temperature excursion. The resulting heat can destroy the filter and damage surrounding structures. Recovery can be an expensive process.

To prevent potentially hazardous situations, accumulated particulate matter is commonly oxidized and removed in a controlled regeneration process before excessive levels have accumulated. To oxidize the accumulated particulate matter, exhaust gas temperatures generally must exceed the temperatures typically reached at the filter inlet. Consequently, additional methods to initiate regeneration of a diesel particulate filter may be used. In one method, a reactant, such as diesel fuel, is introduced into an exhaust after-treatment system to initiate oxidation of particulate buildup and to increase the temperature of the filter. A filter regeneration event occurs when substantial amounts of soot are consumed on the particulate filter.

A controlled regeneration can be initiated by the engine's control system when a predetermined amount of particulate has accumulated on the filter, when a predetermined time of engine operation has passed, or when the vehicle has driven a predetermined number of miles. Oxidation from oxygen ($O_2$) generally occurs on the filter at temperatures above about 400° C., while oxidation from nitric oxides ($NO_2$), sometimes referred to herein as noxidation, generally occurs at temperatures between about 250° C. and 400° C. Controlled regeneration typically consists of driving the filter temperature up to $O_2$ oxidation temperature levels for a predetermined time period such that oxidation of soot accumulated on the filter takes place.

A controlled regeneration can become uncontrolled if the oxidation process drives the temperature of the filter upwards more than is anticipated or desired, sometimes to the point beyond which the filter substrate material can absorb the heat, resulting in melting or other damage to the filter. Less damaging uncontrolled or spontaneous regeneration of the filter can also take place at noxidation temperatures, i.e., when the filter temperature falls between about 250° C. and 400° C. Such uncontrolled regeneration generally does not result in runaway temperatures, but can result in only partial regeneration of the soot on the filter. Partial regeneration can also occur when a controlled regeneration cannot continue because of a drop in temperature, exhaust gas flow rate, or the like. Partial regeneration and other factors can result in non-uniformity of soot distribution across the filter, resulting in soot load estimation inaccuracies and other problems.

The temperature of the particulate filter is dependent upon the temperature of the exhaust gas entering the particulate filter. Accordingly, the temperature of the exhaust must be carefully managed to ensure that a desired particulate filter inlet exhaust gas temperature is accurately and efficiently reached and maintained for a desired duration to achieve a controlled regeneration event that produces desired results.

Conventional systems use various strategies for managing the particulate filter inlet exhaust gas temperature. For example, some systems use a combination of air handling strategies, internal fuel dosing strategies, and external fuel dosing strategies. The air handling strategies include managing an air intake throttle to regulate the air-to-fuel ratio. Lower air-to-fuel ratios, e.g., richer air/fuel mixtures, typically produce a higher engine outlet exhaust gas temperature. Internal fuel dosing strategies include injecting additional fuel into the compression cylinders. Such in-cylinder injections include pre-injections or fuel injections occurring before a main fuel injection and post-injections or fuel injection occurring after a main fuel injection. Generally, post-injections include heat post-injections and non-heat post-injections. Heat post-injections are injections that participate along with the main fuel injection in the combustion event within the cylinder and occur relatively soon after the main fuel injection. Non-heat post injections are injections occur later in the expansion stroke compared to the heat post-injections and do not participate in the combustion event within the cylinder.

In internal combustions engines, unburned fuel can be forced by a combustion event to slip past, e.g., blow-by, the seals between the piston head and the wall of the compression cylinder. The unburned fuel that slips past the seals enters the crankshaft case chamber below the compression cylinders and intermixes with, e.g., dilutes, lubricating oil stored in the chamber. The fuel dilution level of an engine then is a measure of unburned fuel in the lubricating oil in the crankshaft case (often expressed as the percentage of unburned fuel in the fuel/oil mixture). Most engines generate normal amounts of fuel dilution (e.g., less than about 3%-5%), which often evaporates from the heat of the engine without negatively affecting the engine. However, when fuel dilution levels reach above-normal levels, the fuel does not burn off and may excessively thin the oil. Fuel diluted oil having excessively high fuel dilution levels can lower the lubricating properties of the oil, which can cause a drop in oil pressure and an increase in engine wear. Therefore, preventing the fuel dilution level of an engine from reaching above-normal amounts is an important part of proper engine maintenance and performance.

Although conventional regeneration fuel injection strategies may be adequate for controlling the temperature of exhaust generated by the engine, they often fail to maintain acceptable fuel dilution levels. For example, conventional systems with one heat post-injection participating in the combustion of fuel within the cylinder results in excessively high fuel dilution levels. Further, conventional regeneration fuel injection strategies result in more than typical amounts of fuel being injected into the compression cylinder. As discussed above, some of this fuel does not participate in the combustion event, i.e., the fuel is not combusted, and is not vaporized. With more fuel being injected into the compression cylinder than can be combusted and less vaporization of the fuel, the cylinders often contain excessive amounts of unburned and unvaporized fuel, which typically leads to increased fuel dilution levels.

Another known shortcoming of conventional engine systems having a particulate filter is the negative impact a regeneration event has on the performance of the engine, particularly during transient operations. Common non-additive engine controls strategies are designed primarily to achieve a desired engine outlet exhaust gas temperature without much attention being paid to the decrease in performance caused by such strategies. For example, some conventional engine control strategies that include multiple pre- and post-injections result in low combustion efficiencies due to the extra fuel in the combustion chamber. Reduced combustion efficiencies can cause a reduction in the performance, e.g., speed, torque, and fuel economy, of the engine.

Based on the foregoing, a need exists for an engine controls strategy that achieves targeted engine outlet exhaust gas temperatures for desired regeneration events while maintaining fuel dilution levels at or below an acceptable level for the engine and reducing negative effects on the performance of the engine during regeneration events conducted at various engine operating conditions.

SUMMARY

The subject matter of the present application has been developed in response to the present state of the art, and in particular, in response to the problems and needs in the art that have not yet been fully solved by currently available engine controls strategies for regeneration events. Accordingly, the subject matter of the present application has been developed to provide apparatus, systems, and methods for controlling the engine exhaust gas temperatures, fuel dilution levels, and engine performance during regeneration events that overcomes at least some shortcomings of the prior art engine controls strategies for regeneration events.

For example, according to one representative embodiment, an apparatus for controlling the temperature of the output exhaust of an internal combustion engine for a regeneration event on a particulate matter filter includes a regeneration module, a turbocharger thermal management module, a fuel injection thermal management module, and an air intake thermal management module. The regeneration module determines a desired particulate matter filter inlet exhaust gas temperature for a regeneration event. The turbocharger thermal management module determines a variable geometry turbine (VGT) device position strategy. The fuel injection thermal management module determines a fuel injection strategy. The air intake throttle thermal management module determines an intake throttle position strategy. The VGT device position strategy, the post-injection fuel injection strategy, and the intake throttle position strategy cooperatively achieve the desired particulate matter filter inlet exhaust gas temperature and maintain a fuel dilution level of the engine below a maximum fuel dilution level.

In some implementations, the apparatus also includes an exhaust gas recirculation (EGR) thermal management module that determines an exhaust throttle valve position strategy. In such implementations, the VGT device position strategy, the fuel injection strategy, the intake throttle position strategy, and the exhaust throttle valve position strategy cooperatively achieve the desired particulate matter filter inlet exhaust gas temperature. In specific instances, the internal combustion engine is operable in a low speed operating range, a high speed operating range, and a transition operating range between the low and high speed operating ranges. In such instances, the exhaust throttle valve position strategy includes closing the exhaust throttle valve when operating in the low speed operating range, and opening the exhaust throttle valve when operating in the high speed operating range.

According to certain embodiments, the fuel injection thermal management module includes a fuel dilution module configured to determine a maximum fuel dilution level of the engine, wherein the fuel injection strategy is configured to achieve an actual fuel dilution level below or equal to the maximum fuel dilution level.

In some implementations, the internal combustion engine is operable in a low speed operating range, a high speed operating range, and a transition operating range between the low and high speed operating ranges. The VGT device position strategy can include closing the VGT device when operating in the low speed operating range, opening the VGT device when operating in the high speed operating range, and moving the VGT device between the closed and open position in the transition operating range when the engine is transitioning between the low speed operating range and the high speed operating range. The engine is also operable in an intermediate speed operating range overlapping at least a portion of the low speed operating range, the entire transition operating range, and at least a portion high speed operating range. The fuel injection strategy can include at least one heat post-injection. In some instances, the fuel injection strategy also includes at least one non-heat post-injection when operating in the low and intermediate speed operating range.

According to another embodiment, a method is disclosed for controlling the temperature of the inlet exhaust of a particulate matter filter for a regeneration event on the particulate matter filter. The particulate matter filter is coupled in exhaust receiving communication with an internal combustion engine. The method includes determining a desired particulate matter filter inlet exhaust gas temperature. Additionally, the method includes determining and implementing a VGT device position strategy for achieving the desired particulate matter filter inlet exhaust gas temperature. If the VGT device position strategy does not achieve an actual particulate matter filter inlet exhaust gas temperature approximately equal to or greater than the desired particulate matter filter inlet exhaust gas temperature, the method includes determining and implementing a multiple post-injection strategy for achieving the desired particulate matter filter inlet exhaust gas temperature. If, however, the multiple-post injection strategy does not achieve an actual particulate matter filter inlet exhaust gas temperature approximately equal to or greater than the desired particulate matter filter inlet exhaust gas temperature, the method includes determining and implementing an intake throttle position strategy for achieving the desired particulate matter filter inlet exhaust gas temperature.

According to some implementations, the method further includes determining and implementing an exhaust throttle valve position strategy for achieving the desired particulate matter filter inlet exhaust gas temperature if the VGT device position strategy does not achieve an actual particulate matter filter inlet exhaust gas temperature approximately equal to or greater than the desired particulate matter filter inlet exhaust gas temperature. The multiple post-injection strategy for achieving the desired particulate matter filter inlet exhaust gas temperature is determined and implemented if the if the exhaust throttle valve position strategy does not achieve an actual particulate matter filter inlet exhaust gas temperature approximately equal to or greater than the desired particulate matter filter inlet exhaust gas temperature.

In certain implementations, the method includes determining whether a smooth transition limit of the VGT device has been met. If the smooth transition limit of the VGT device has been met, the method further includes determining and implementing a new VGT device position strategy for achieving the desired particulate matter filter inlet exhaust gas temperature and avoiding an un-smooth transition of the VGT device.

In yet certain implementations, the method includes determining whether the exhaust flow rate meets or exceeds an exhaust flow rate lower limit after implementation of the intake throttle position. If the exhaust flow rate does not meet or exceed the exhaust flow rate lower limit, the method further includes determining and implementing a new intake throttle position strategy for achieving the desired particulate matter filter inlet exhaust gas temperature and meeting or exceeding the exhaust flow rate lower limit.

According to some implementations, the action of determining the multiple post-injection strategy includes determining a desired exhaust gas temperature increase from heat post-injections and determining whether one heat post-injection is sufficient to achieve the desired exhaust gas temperature increase. If one heat post-injection is not sufficient, the method includes determining whether two heat post-injections are sufficient to achieve the desired exhaust gas temperature increase.

After implementing the multiple post-injection strategy of the method, the method further includes determining whether an actual fuel dilution level of the engine exceeds a predetermined maximum fuel dilution level of the engine. If the actual fuel dilution level of the engine exceeds the predetermined maximum fuel dilution level of the engine, the method includes determining and implementing a new multiple post-injection strategy for achieving the desired particulate matter filter inlet exhaust gas temperature and reducing or maintaining the actual fuel dilution level of the engine to a level at or below the maximum fuel dilution level.

In some implementations, the action of determining the multiple post-injection strategy can include determining a desired filter inlet exhaust gas temperature increase from non-heat post-injections and determining whether one non-heat post-injection is sufficient to achieve the desired filter inlet exhaust gas temperature increase. If one non-heat post-injection is sufficient, the method includes setting the number of non-heat post-injections of the multiple post-injection strategy to one non-heat post-injection. If one non-heat post-injection is not sufficient, the method includes determining whether two non-heat post-injections are sufficient to achieve the desired exhaust gas temperature increase. If two non-heat post-injections are sufficient, the method includes setting the number of non-heat post-injections of the multiple post-injection strategy to two non-heat post-injections. But, if two non-heat post-injections are not sufficient, the method includes setting the number of non-heat post-injections of the multiple post-injection strategy to three non-heat post-injections.

According to another embodiment, a method for controlling the temperature of the inlet exhaust of a particulate matter filter coupled to an internal combustion engine for a regeneration event on the particulate matter filter includes determining a desired particulate matter filter inlet exhaust gas temperature. The method also includes determining a VGT device position strategy configurable to increase the filter inlet exhaust gas temperature during a regeneration event, determining an exhaust throttle valve position strategy configurable to increase the filter inlet exhaust gas temperature during a regeneration event, determining a multiple post-injection strategy configurable to increase the filter inlet exhaust gas temperature during a regeneration event, and determining an intake throttle position strategy configurable to increase the filter inlet exhaust gas temperature during a regeneration event. The method further includes cooperatively implementing the VGT device position strategy, exhaust throttle valve position strategy, multiple post-injection strategy, and intake throttle position strategy to increase the filter inlet exhaust gas temperature to the desired particulate matter filter inlet exhaust gas temperature.

According to another embodiment, an internal combustion engine system includes an internal combustion engine generating an engine outlet exhaust, a particulate matter filter in exhaust receiving communication with the internal combustion engine, and a controller. The controller includes an engine conditions module configured to determine operating conditions of the engine and a regeneration module configured to determine a desired particulate matter filter inlet exhaust gas temperature for conducting a regeneration event on the particulate matter filter. The controller further includes an engine system thermal management module configured to determine a VGT device actuation strategy for increasing the temperature of exhaust entering the particulate matter filter a first desired amount, an exhaust throttle actuation strategy for increasing the temperature of exhaust entering the particulate matter filter a second desired amount, a regeneration fuel injection strategy for increasing the temperature of exhaust entering the particulate matter filter a third desired amount, and an air intake throttle actuation strategy for increasing the temperature of exhaust entering the particulate matter filter a fourth desired amount. The first, second, third, and fourth desired temperature increase amounts are combinable to increase the temperature of exhaust entering the particulate matter filter to a temperature at or above the desired particulate matter filter inlet exhaust gas temperature.

The first, second, third, and fourth desired temperature increase amounts can each be any of various temperature increase amounts ranging from zero up to any desired amount. A desired temperature increase amount can be set to zero if it is undesirable for a particular component, e.g., VGT device, exhaust throttle, post-injections, and intake throttle, to participate in the exhaust gas temperature increase process.

In some implementations, the engine system thermal management module is configured to determine a fuel dilution threshold level and the internal combustion engine is operable in a low fuel dilution mode when the fuel dilution level of the engine exceeds the fuel dilution threshold level. The internal combustion engine is operable in the low fuel dilution mode by setting the third desired temperature increase amount to zero.

In certain instances of the internal combustion engine system, the first desired temperature increase amount is greater than the third desired temperature increase amount. For example, at certain engine operating conditions, the fuel amounts from non-heat post-injections are limited to controlling only the engine outlet hydrocarbon level and fuel dilution level. In other instances, the third desired temperature increase amount is greater than the first desired temperature increase amount. For example, at certain other engine operating conditions, VGT position is controlled such that the exhaust flow rate meets the lower limit requirement and the turbine inlet exhaust pressure meets an upper limit.

According to some implementations of the internal combustion engine system, the engine system thermal management module is configured to determine a fuel dilution threshold level and the regeneration fuel injection strategy is configured to maintain the fuel dilution level of the engine at a level not greater than the fuel dilution threshold level.

Further, in some implementations of the internal combustion engine system, the controller includes a predetermined map that has empirically obtained engine outlet exhaust gas temperatures, particulate matter filter inlet exhaust gas temperatures, and fuel dilution levels for given VGT device positions, exhaust throttle positions, regeneration post-injections, and air intake throttle positions. In such implementations, the determination of the VGT strategy, exhaust throttle actuation strategy, regeneration fuel injection strategy, and air intake actuation strategy by the engine system thermal management module can include accessing data from the predetermined map.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter of the present disclosure may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments. These features and advantages will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
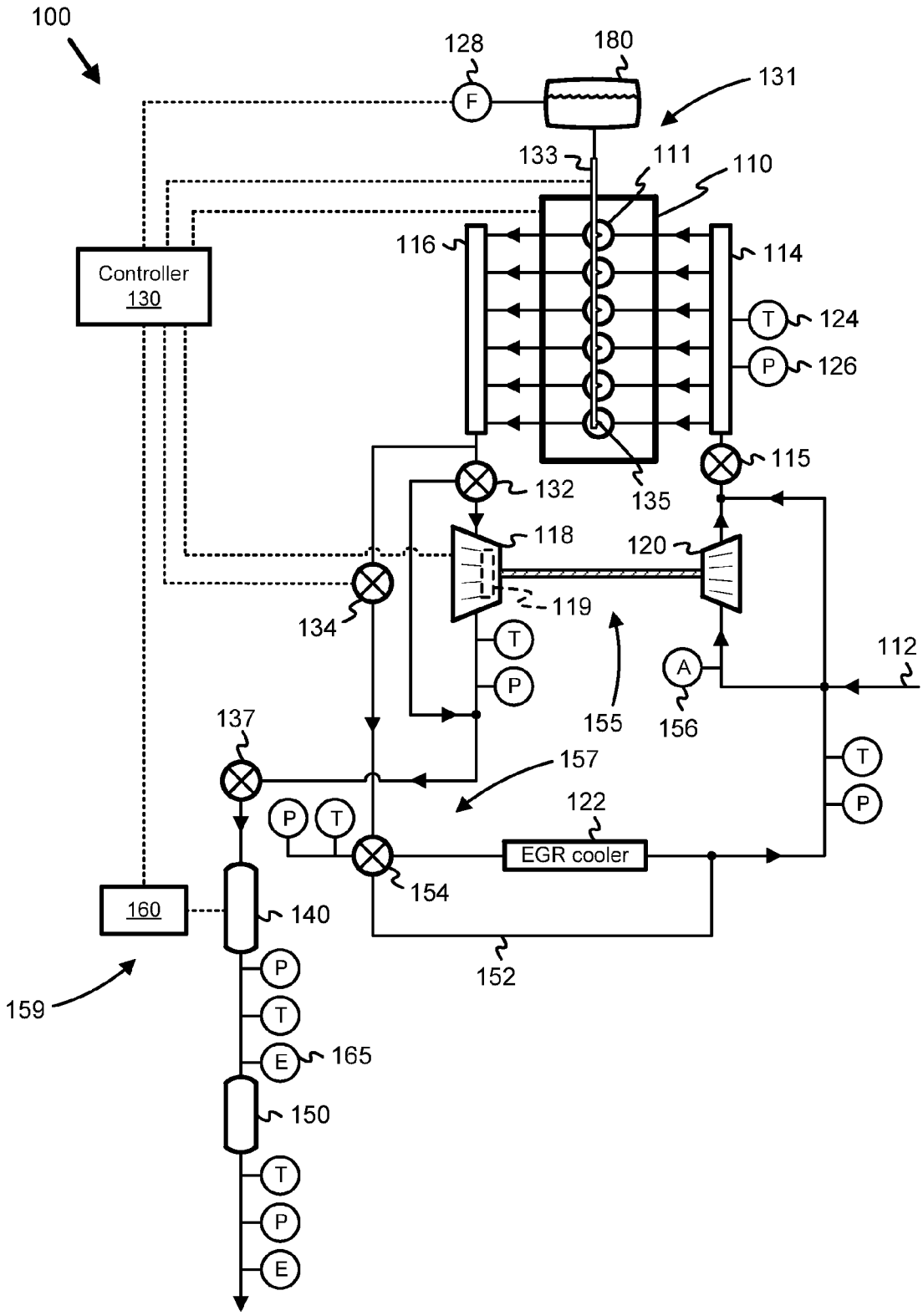
FIG. 1 is a schematic diagram of an engine system having a particulate filter according to one embodiment.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions, which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the subject matter described herein may be combined in any suitable manner in one or more embodiments. In the following description, numerous specific details are provided, such as examples of controls, structures, algorithms, programming, software modules, user selections, network transactions, database queries, database structures, hardware modules, hardware circuits, hardware chips, etc., to provide a thorough understanding of embodiments of the subject matter. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the disclosed subject matter.

FIG. 1 depicts one exemplary embodiment of an internal combustion engine system, such as a diesel engine system 100, in accordance with the present invention. As illustrated, the engine system 100 includes a diesel engine 110, a controller 130, a fuel delivery system 131, a turbocharger system 155, an exhaust gas recirculation (EGR) system 157, and an exhaust gas aftertreatment system 159.

The engine 110 includes an air inlet 112, intake manifold 114, and exhaust manifold 116. The air inlet 112 is vented to the atmosphere, enabling air to enter the engine 110. The air inlet 112 is connected to an inlet of the intake manifold 114. The intake manifold 114 includes an outlet operatively coupled to combustion chambers 111 of the engine 110. The air from the atmosphere is combined with fuel to power, or otherwise, operate the engine 110. The fuel is delivered into the combustion chambers 111 by the fuel delivery system 131. The fuel delivery system 131 includes a fuel tank 180 for storing the fuel and a fuel pump (not shown) for delivery the fuel to a common rail 133. From the common rail, the fuel is injected into combustion chambers 111 through one of several fuel injectors 135. The timing and dosage of fuel into the combustion chambers 111 is controlled by the controller 130 via electronic communication lines (shown as dashed lines in FIG. 1). Combustion of the fuel produces exhaust gas that is operatively vented to the exhaust manifold 116.

The quantity of air entering the intake manifold 114 and thus the combustion chambers 111 is regulated by an intake throttle 115 operatively coupled to an accelerator pedal (not shown). The position of the intake throttle 115 and the quantity of air entering the intake manifold 114 corresponds at least partially to the position of the accelerator pedal. The intake throttle 115 also is in electrical communication with the controller 130 and controllable by the controller. The controller 130 is operable to regulate the quantity of air entering the intake manifold 114 independent of the position of the accelerator pedal.

From the exhaust manifold 116, the exhaust gas flows into at least one of three systems, i.e., the turbocharger system 155, the EGR system 157, and the exhaust gas aftertreatment system 159. For example, based at least partially on the operating conditions of the engine, a portion of the exhaust gas can be directed into the turbocharger system 155, a portion of the exhaust gas can be directed into the EGR system 157, and a portion of the exhaust gas can be directed into the exhaust aftertreatment system 159. The relative portions of exhaust gas entering the respective systems 155, 157, 159 are controlled by the controller 130. Generally, the controller 130 determines the relative portions of exhaust gas that should enter the respective systems and commands valves, e.g., valves 132, 134, to allow a portion of the exhaust corresponding to the determined portions to enter the respective systems.

The turbocharger system 155 includes a turbocharger turbine 118, turbocharger compressor 120, and the turbocharger bypass valve 132. The turbocharger bypass valve 132 is selectively operable to regulate the flow of exhaust gas into the turbocharger turbine 118. The exhaust gas entering the turbine 118 causes the turbine to drive the compressor 120. When driven by the turbine 118, the compressor 120 compresses engine intake air before directing it to the intake manifold 114.

In certain implementations, the turbocharger turbine 118 is a variable geometry turbine (VGT) having a VGT device 119 such as is commonly known in the art. The VGT device 119 can be a series of movable vanes for controlling the flow of exhaust hitting the blades of the turbine. For example, at low engine speeds, the exhaust velocity is insufficient to effectively spin the turbine. Accordingly, at low engine speeds, the vanes can be moved into a relatively closed position such that the spaces between the vanes are relatively small. As the exhaust passes through the small spaces, it accelerates and is redirected to contact the turbine blades at a specific angle for optimum or fully enhanced rotation of the blades. In contrast, at high engine speeds, the exhaust velocity is sufficient to effectively spin the turbine. Accordingly, at high engine speeds, the vanes can be moved into a relatively open position such that the spaces between the vanes are relatively large. As the exhaust passes through the large spaces, its velocity remains relatively constant and experiences minimal redirection such that the blades of the turbine experience a less enhanced rotation. The positions of the vanes are adjusted via an actuator in electrical communication with the controller 130 such that the controller 130 can control the positions of the vanes.

The EGR system 157 includes an EGR cooler 122, an EGR valve 134, and an EGR cooler bypass valve 154. The EGR valve 134 is selectively controlled by the controller 130 to regulate the flow of exhaust entering the EGR system 157 from the exhaust manifold, and thus indirectly regulating the flow of exhaust entering the aftertreatment system 159. When the EGR valve 134 is at least partially open, at least a portion of the engine exhaust enters the EGR system 157 and is re-circulated into the combustion chambers 111 of the engine 110 to be combusted with air from the air intake 112. Prior to entering the combustion chambers 111, the EGR exhaust gas can be passed through the EGR cooler 122 to cool the exhaust gas in order to facilitate increased engine air inlet density. The EGR cooler bypass valve 154 is operatively controlled by the controller 130 to regulate the amount of EGR exhaust passing through the EGR cooler 122 and the amount of EGR exhaust gas bypassing the EGR cooler 122 via an EGR bypass line 152.

In addition to the VGT device 119 and the EGR valve 134, the flow rate of exhaust entering the exhaust aftertreatment system 159 can be regulated by an exhaust throttle 137 positioned within the exhaust stream between the catalytic component 140 and the turbocharger system 155. Like the VGT device 119, the exhaust throttle 137 is actuatable between a closed position and an open position. The closed position corresponds with a minimum space through which exhaust gas can pass and the open position corresponds with a maximum space through which exhaust gas can pass. As the space through which the exhaust flows is reduced, the flow rate of the exhaust is reduced. Therefore, as the exhaust throttle 137 moves from the open position to the closed position, the flow rate of exhaust entering the aftertreatment system 159 decreases. Similarly, as the exhaust throttle 137 moves from the closed position to the open position, the flow rate of exhaust entering the aftertreatment system 159 increases.

The valve positions of the VGT device 119 and exhaust throttle 137 affect the load on the engine and thus the temperature of the exhaust gas. For example, when the VGT device 119 is in a closed position, a backpressure is created in the exhaust manifold. In order to overcome the backpressure in the exhaust, the engine must increase its pumping work, e.g., load. The increased pumping work results in an increase in the engine outlet exhaust gas temperature. Similar to the VGT device 119, the more closed the exhaust throttle 137 valve position, the more backpressure created in the exhaust manifold, and the more pumping work performed by the engine. Accordingly, in certain instances, the temperature of the engine outlet exhaust can be increased by closing at least one of the VGT device 119 and exhaust throttle 137. For example, in some implementations, the VGT device 119 and exhaust throttle 137 can be controlled independent of each other to increase the engine outlet exhaust gas temperature. Alternatively, the VGT device 119 and exhaust throttle 137 can be dependently or cooperatively controlled to provide more precise control of the engine outlet exhaust gas temperature.

The exhaust aftertreatment system 159 includes a catalytic component 140, a particulate filter 150 downstream of the catalytic component 140, and a regeneration mechanism. The exhaust gas may pass through one or more catalytic components, such as catalytic component 140, to reduce the number of pollutants in the exhaust gas prior to the gas entering the particulate filter. In certain implementations, the catalytic component 140 is a conventional diesel oxidation catalyst. The pollutants, e.g., carbon monoxide, particulate matter, and hydrocarbons, are reduced in an oxidation process within the catalytic component 140. Typically, for oxidation of the pollutants to occur, the catalyst of the catalytic component 140 much be at a temperature within a predetermined range, e.g., between about 250° C. and about 300° C. in some instances. The temperature of the catalytic component 140 is regulated by controlling the engine outlet exhaust gas temperature. The exothermic oxidation process for reducing the pollutants in the exhaust also causes the temperature of the exhaust gas to increase such that during an oxidation event on the catalytic component 140, the catalytic component outlet exhaust gas temperature is greater than the catalytic component outlet exhaust gas inlet temperature. In some implementations, fuel is added to the exhaust prior to entering the catalytic component 140. The added fuel raises the temperature of the exhaust exiting the catalytic component 140 by participating in the exothermic oxidation reaction. The amount of fuel added to the exhaust gas is proportional to the increase in the exhaust gas temperature due to the catalytic component 140, i.e., the catalytic component exhaust gas temperature increase.

The particulate filter 150 filters particulate matter from the exhaust gas stream before venting to the atmosphere. The particulate matter can build on the face of the particulate filter catalyst. Particulate matter produced by the engine 110 comprises ash and soot. Soot accumulates much faster than ash, such that, in many cases, particularly when the filter has been in operation for a relatively short period, an estimate of the rate of total particulate accumulation can be satisfactorily generated by estimating the rate of soot accumulation, treating the ash accumulation rate as negligible. Accordingly, the particulate filter 150 requires periodic regeneration to remove the particulate matter from the filter. The regeneration mechanism 160 regenerates the filter 150, with the controller 130 establishing a regeneration vector and directing the regeneration mechanism 160 to regenerate the filter 150 in a regeneration profile corresponding to the regeneration vector, as further detailed below.

Various sensors, such as temperature sensors 124, pressure sensors 126, fuel sensor 128, exhaust gas flow sensors 165, and the like, may be strategically disposed throughout the engine system 100 and may be in communication with the controller 130 to monitor operating conditions. In one embodiment, the fuel sensor 128 senses the amount of fuel consumed by the engine, and the exhaust gas flow sensors 165 sense the rate at which exhaust gas is flowing at the particulate filter 150.

Engine operating conditions can be ascertained from any of the sensors or from the controller 130's commands to the engine regarding the fraction of exhaust gas recirculation, injection timing, and the like. In one embodiment, information is gathered regarding, for example, fuel rate, engine speed, engine load, the timing at which fuel injection timing is advanced or retarded (SOI, or start of injection), time passed, fraction of exhaust gas recirculation, driving conditions, whether and when regenerations have occurred and the rate such regenerations have removed particulate matter, exhaust flow rate, the amount of $O_2$ and $NO_2$ in the exhaust, filter temperature, exhaust gas pressure, filter particulate load amount and uniformity, etc.

The engine 110 will produce soot and ash at a rate that will vary according to the type of engine; for example, whether it is an 11-liter or 15-liter diesel engine. Additionally, the rate of particulate production will vary according to engine operating conditions such as fuel rate, EGR fraction, and SOI timing. Other factors may also bear on the particulate production rate, some depending heavily on the engine platform being considered, with others closer to being platform-independent.

Although the engine system 100 shown in FIG. 1 uses an internal fuel injection approach to controlling the exhaust gas temperature for regeneration events, in other embodiments, an external fuel injection approach can be used in conjunction with the non-additive fuel injection strategies described herein. The external fuel injection approach can be the same as or similar to the approach described in U.S. Pat. No. 7,263,825, which is incorporated herein by reference.

Figure 2:
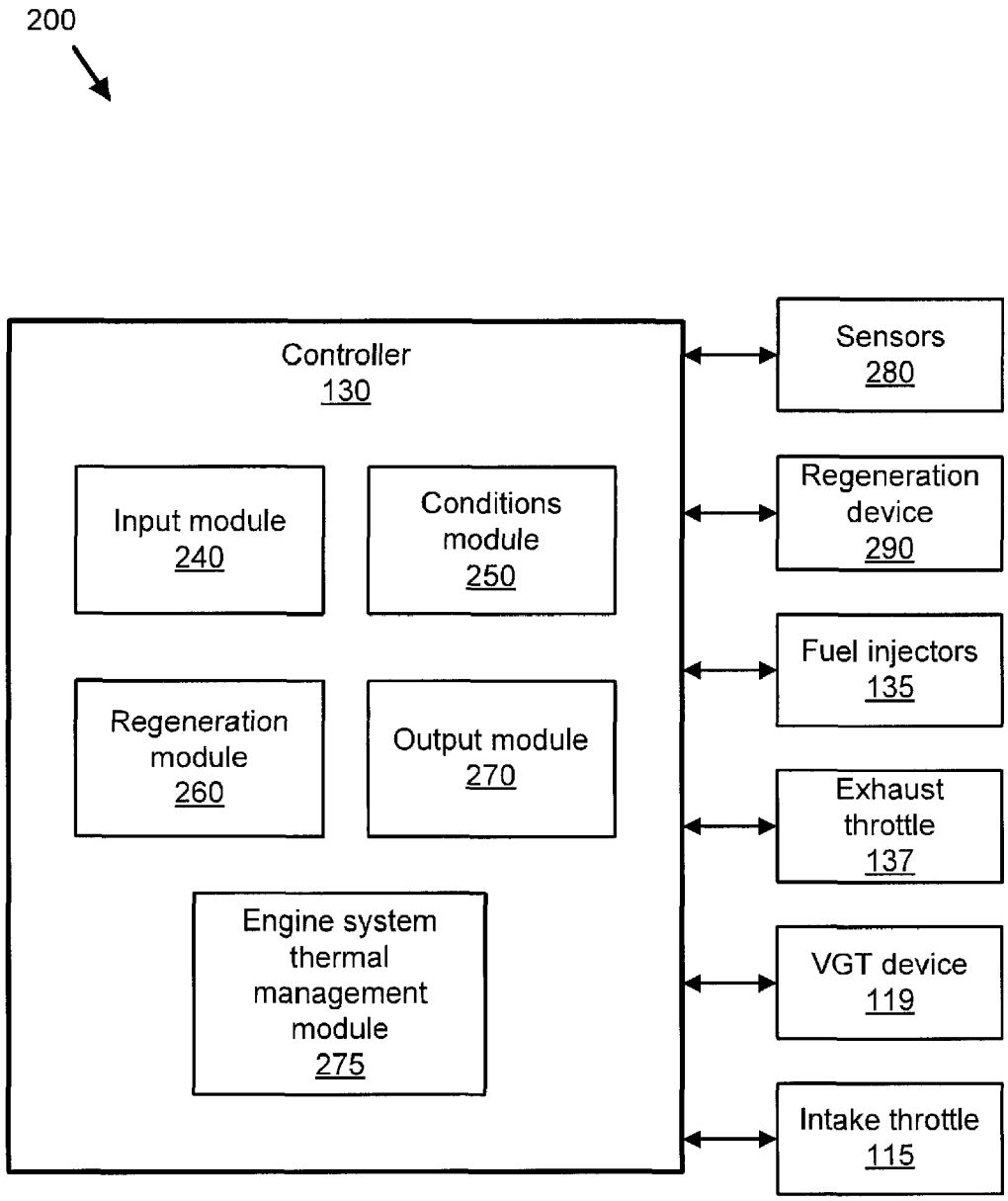
FIG. 2 is a schematic diagram of a control system of the engine system according to one embodiment.

FIG. 2 depicts a control system 200 according to one representative embodiment. The control system 200 includes the controller 130, the intake throttle 115, the VGT device 119, the exhaust throttle 137, sensors 280 (e.g., sensors 124, 126, 128, 165), a regeneration device 290 (e.g., the regeneration mechanism 160), and the fuel injectors 135. The controller 130 includes an input module 240, a conditions module 250, a regeneration module 260, an output module 270, and an engine system thermal management module 275.

As is known in the art, the controller 130 and components may comprise processor, memory, and interface modules that may be fabricated of semiconductor gates on one or more semiconductor substrates. Each semiconductor substrate may be packaged in one or more semiconductor devices mounted on circuit cards. Connections between the modules may be through semiconductor metal layers, substrate-to-substrate wiring, or circuit card traces or wires connecting the semiconductor devices.

The sensors 280 are configured to determine a plurality of conditions within the engine system 100, including temperature, pressure, exhaust gas flow rate, etc. The regeneration device 290 is configured to regenerate the filter 150 at the direction of the controller 150. The input module 240 is configured to input the conditions sensed by the sensors 280 and provide corresponding inputs to the regeneration module 260, which creates a regeneration vector according to the inputs. The conditions module 250 is configured to gather information regarding current operating conditions 430 of the engine system 100, based on the conditions sensed by the sensors 280 and/or other inputs including commands issued to system components by the controller 130.

The output module 270 is configured to direct the regeneration device 290 to regenerate the filter 150 according to regeneration instructions generated by the regeneration module 260 and the current conditions determined by the conditions module 250. The output module 270 also is configured to direct the fuel injectors 135 to inject fuel into the compression chambers of the engine 110 according to a fuel injection strategy determined by the engine system thermal management module 275. Further, the output module 270 is configured to direct the intake throttle 115 to regulate the flow rate of intake air into the intake manifold 114 according to a desired intake air flow rate determined by the engine system thermal management module 275. The output module 270 also is configured to command the VGT device 119 into a desired configuration determined by the engine system thermal management module 275. Further, the output module 270 is configured to direct the exhaust throttle 137 to regulate the flow rate of exhaust entering the exhaust aftertreatment system 159 according to a desired aftertreatment system exhaust flow rate determined by the engine system thermal management module 275.

Figure 3:
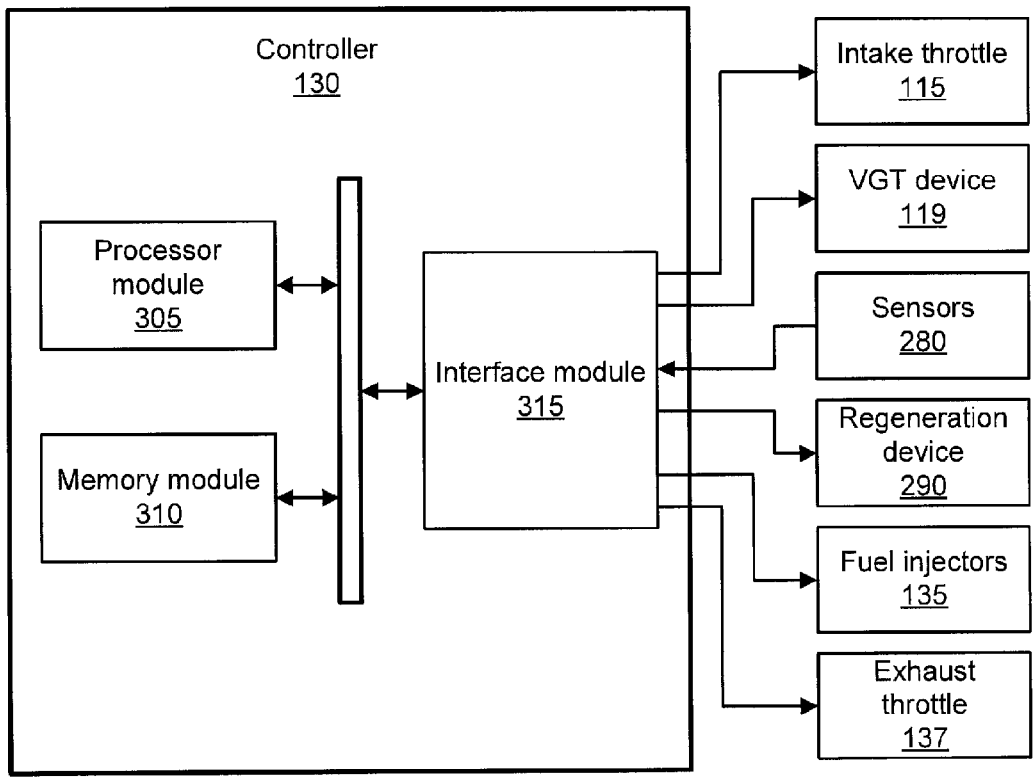
FIG. 3 is a schematic diagram of a controller of the engine system according to another embodiment.

FIG. 3 is a schematic block diagram illustrating another embodiment of the control system 200 of FIG. 2. The controller 130 is depicted as comprising a processor module 305, memory module 310, and interface module 315. The processor module 305, memory module 310, and interface module 315 may be fabricated of semiconductor gates on one or more semiconductor substrates. Each semiconductor substrate may be packaged in one or more semiconductor devices mounted on circuit cards. Connections between the processor module 305, the memory module 310, and the interface module 315 may be through semiconductor metal layers, substrate to substrate wiring, or circuit card traces or wires connecting the semiconductor devices.

The memory module 310 stores software instructions and data comprising one or more software processes. The processor module 305 executes the software processes as is known to those skilled in the art. In one embodiment, the processor module 305 executes one or more software processes carried out by the conditions module 250, regeneration module 260, and engine system thermal management module 275 of FIG. 2.

The processor module 305 may communicate with external devices and sensors, such as the sensors 280, the regeneration device 290, the fuel injectors 135, the intake throttle 115, the VGT device 119, and the exhaust throttle 137, of FIG. 2 through the interface module 315. For example, the sensors 280 may comprise a pressure sensor 126 (FIG. 1), with the sensors 280 communicating an analog signal representing a pressure value to the interface module 315. The interface module 315 may periodically convert the analog signal to a digital value and communicate the digital value to the processor module 305.

The interface module 315 may also receive one or more digital signals through a dedicated digital interface, a serial digital bus communicating a plurality of digital values, or the like. For example, the sensors 280 may comprise the air-flow sensor 156 of FIG. 1 and communicate a digital air flow value to the interface module 315. The interface module 315 may periodically communicate the digital air flow value to the processor module 305. In one embodiment, the interface module 315 executes one or more communication processes carried out by the input module 240 and output module 270 of FIG. 2.

The processor module 305 may store digital values such as the pressure value and the air flow value in the memory module 310. In addition, the processor module 305 may employ the digital values in one or more calculations including calculations carried out by the conditions module 250 and regeneration module 260. The processor module 305 may also control one or more devices, such as the fuel injectors 135, intake throttle, 115, VGT device 119, exhaust throttle 137, and regeneration device 290, through the interface module 315.

The regeneration module 260 is configured to generate a regeneration command, e.g., regeneration instructions, representing a request to initiate a regeneration event on the particulate filter 150 and the desired characteristics of the regeneration event. In other words, the regeneration module 260 commands the regeneration device when to perform a regeneration event, how long to perform the regeneration event, the rate of regeneration during the regeneration event, and determines the desired temperature of the exhaust entering the particulate filter (e.g., a desired filter inlet exhaust gas temperature 425) necessary to achieve the desired characteristics of the regeneration event.

Based on the desired filter inlet exhaust gas temperature 425 (i.e., desired catalytic component or DOC outlet exhaust gas temperature), the regeneration module 260 is configured to determine a desired temperature of the exhaust exiting the exhaust manifold 116 (e.g., a desired engine outlet exhaust gas temperature 435). In embodiments where the engine system 100 includes a catalytic component 140, the filter inlet exhaust gas temperature is equal to the engine outlet exhaust gas temperature plus the exhaust gas temperature increase produced by the catalytic component 140. The desired filter inlet exhaust gas temperature 425 then is equal to the desired engine outlet exhaust gas temperature 435 plus a desired catalytic component exhaust gas temperature increase. Accordingly, the desired filter exhaust gas temperature 425 is achievable by controlling at least one of the engine outlet exhaust gas temperature and the catalytic component exhaust gas temperature increase. Further, the determination of the desired engine outlet exhaust gas temperature 435 of the engine includes an anticipated drop in the temperature due to the turbine 118. Therefore, the regeneration module 260 compensates for the changes in exhaust gas temperature due to operation of the turbine 118 in its determination of the desired engine outlet exhaust gas temperature 435.

Generally, the regeneration command and associated regeneration event characteristics are dependent upon the accumulation and/or distribution of particulate matter on the filter 150. Additionally, the regeneration command and event characteristics are dependent upon any of various other parameters, such as, for example, the operating conditions of the engine, the availability of future regeneration opportunities, the operating trends of the engine, etc. In certain embodiments, the regeneration module 260 generates the regeneration command by utilizing the particulate filter regeneration principles and strategies described in U.S. patent application Ser. Nos. 11/301,808 (filed Dec. 13, 2005), 11/301,998 (filed Dec. 13, 2005), 11/301,701 (filed Dec. 13, 2005), 11/227,857 (filed Sep. 15, 2005), 11/227,403 (filed Sep. 15, 2005), 11/301,693 (filed Dec. 13, 2005), 11/227,828 (filed Sep. 15, 2005), 11/226,972 (filed Sep. 15, 2005), 11/227,060 (filed Sep. 15, 2005), and 12/039,614 (filed Feb. 28, 2008), and U.S. Pat. Nos. 7,231,291; 7,263,825; and 7,188,512. Each of the above-listed patents and patent applications are incorporated herein by reference.

Figure 4:
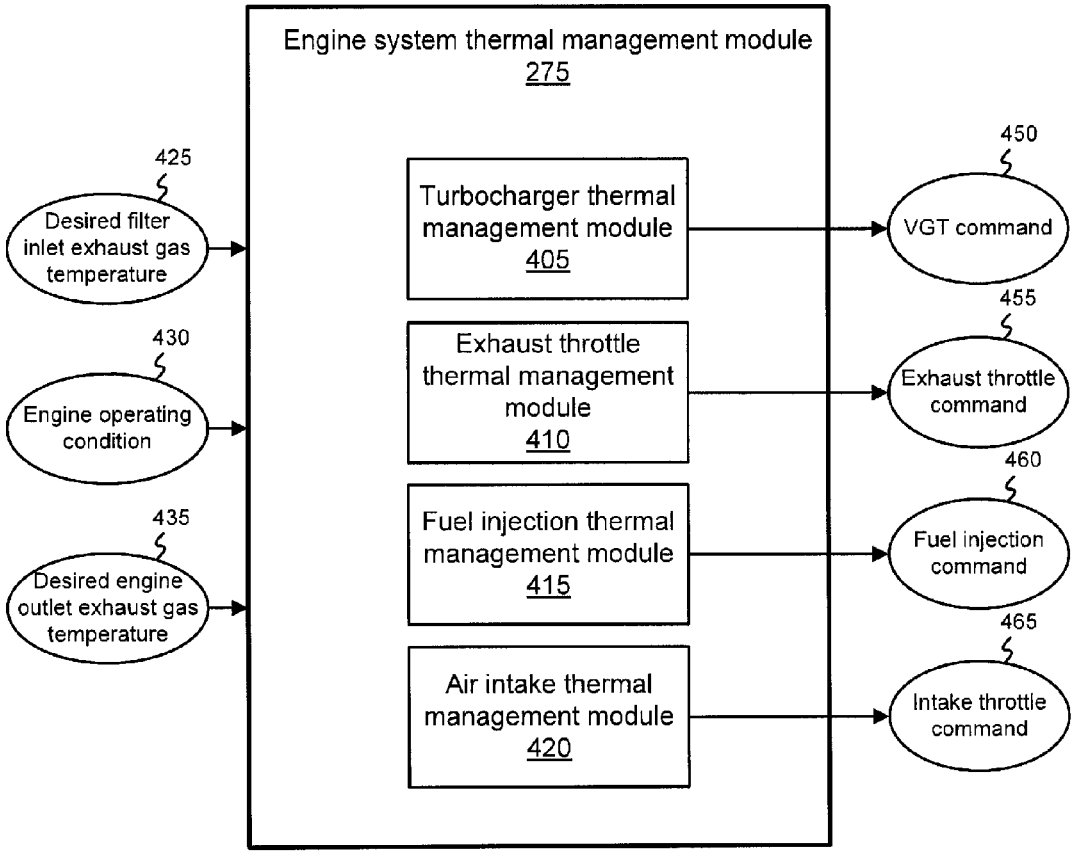
FIG. 4 is a schematic diagram of an engine system thermal management module of the controller of FIG. 2.

The regeneration module 260 communicates the regeneration command, or at least certain portions of the regeneration command, to the engine system thermal management module 275. In one embodiment, as shown in FIG. 4, the regeneration module 260 communicates the desired filter inlet exhaust gas temperature 425 and desired engine outlet exhaust gas temperature 435 of the regeneration command to the engine system thermal management module 275.

The engine system thermal management module 275 includes a turbocharger thermal management module 405, an exhaust throttle thermal management module 410, a fuel injection thermal management module 415, and an air intake thermal management module 420. Generally, the engine system thermal management module 275 determines a thermal management strategy for each cycle of the engine 110. Each thermal management strategy represents the operating parameters of one or more components of the engine system estimated to achieve the desired filter inlet exhaust gas temperature, maintain the dilution level below a maximum dilution level threshold, and attain a desired engine outlet performance for each engine cycle during regeneration events. Further, based at least partially on the desired filter inlet exhaust gas temperature 425 and desired engine outlet exhaust gas temperature 435 received from the regeneration module 260, the engine system thermal management module 275 determines a thermal management strategy for achieving a desired engine outlet exhaust gas temperature and, if necessary, a desired catalytic component exhaust gas temperature increase that together provide the desired filter inlet exhaust gas temperature 425.

The thermal management strategy is represented by one or more component commands generated by the engine system thermal management module 275 and communicated to the respective components. In the illustrated embodiment, the commands includes at least one of a VGT command 450, an exhaust throttle command 455, a fuel injection command 460, and an intake throttle command 465. Generally, the commands 450, 455, 460, 465 are configured to achieve the desired engine outlet exhaust gas temperature and any desired catalytic component exhaust gas temperature increase.

The VGT command 450 is originally generated from the turbocharger thermal management module 405. The VGT command 450 represents a VGT device position strategy regarding the position of the VGT device 119 relative to the speed and torque of the engine. In a first engine operating range 570, e.g., at relatively lower operating speeds, the VGT command 450 can request a closed position of the VGT device 119 (see FIG. 5). With the VGT device 119 closed, the engine outlet exhaust gas temperature is increased due to the increased energy consumed to expel exhaust gas from the engine cylinders, which increases the pumping work performed by the engine. In a second engine operating range 580, e.g., at relatively higher engine speeds and lower torques, the VGT command 450 can request an open position of the VGT device 119 (see FIG. 5). With the VGT device 119 open during operation in the second engine operating range 580, the air-to-fuel ratio is reduced because less intake air is flowing into the combustion chamber. With less air in the combustion chamber, the temperature of the resultant exhaust gas is increased. Accordingly, the VGT device 119 can be commanded to close and open to increase the temperature of the exhaust exiting the engine in order to meet the desired filter exhaust gas temperature 425 for a regeneration event.

Similar to the turbocharger thermal management module 405, the exhaust throttle thermal management module 410 is configured to generate the exhaust throttle command 455. The exhaust throttle command 455 represents an exhaust throttle strategy regarding the position of the exhaust throttle 137 valve relative to the speed and torque of the engine. The position of the exhaust throttle 137 valve affects the temperature of the exhaust gas generated by the engine much in the same way as the VGT device 119. For example, when the exhaust throttle 137 valve is closed during operation within the first engine operating range 570, the engine outlet exhaust gas temperature is increased.

In certain implementations, the turbocharger and exhaust throttle thermal management modules 405, 410 are in electrical communication and work together to generate a VGT command 450 and exhaust throttle command 455 that cooperatively produce an engine outlet exhaust gas temperature corresponding to the desired engine outlet exhaust gas temperature 435. For example, the VGT device 119 can be opened or closed and the exhaust throttle 137 valve can be positionable in any of various positions between the open and closed positions to provide any of various engine outlet exhaust gas temperature increases.

The VGT device 119 also is positionable in any of various positions between the open and closed positions. However, when changing between the open and closed positions during transient operating conditions of the engine, slow transient response, torque transparency, and VGT actuator reliability problems can occur. Therefore, during transient operations, the VGT device 119 may be an unreliable and problematic exhaust gas temperature control device for a narrow operating speed transition range when the VGT device is changing between the closed and open position. In other words, with regards to changes in the engine outlet exhaust gas temperature, the transition between the first and second engine operating ranges 570, 580, and a third transition operating range 590 intermediate the first and second engine operating ranges may be rough.

Figure 5:
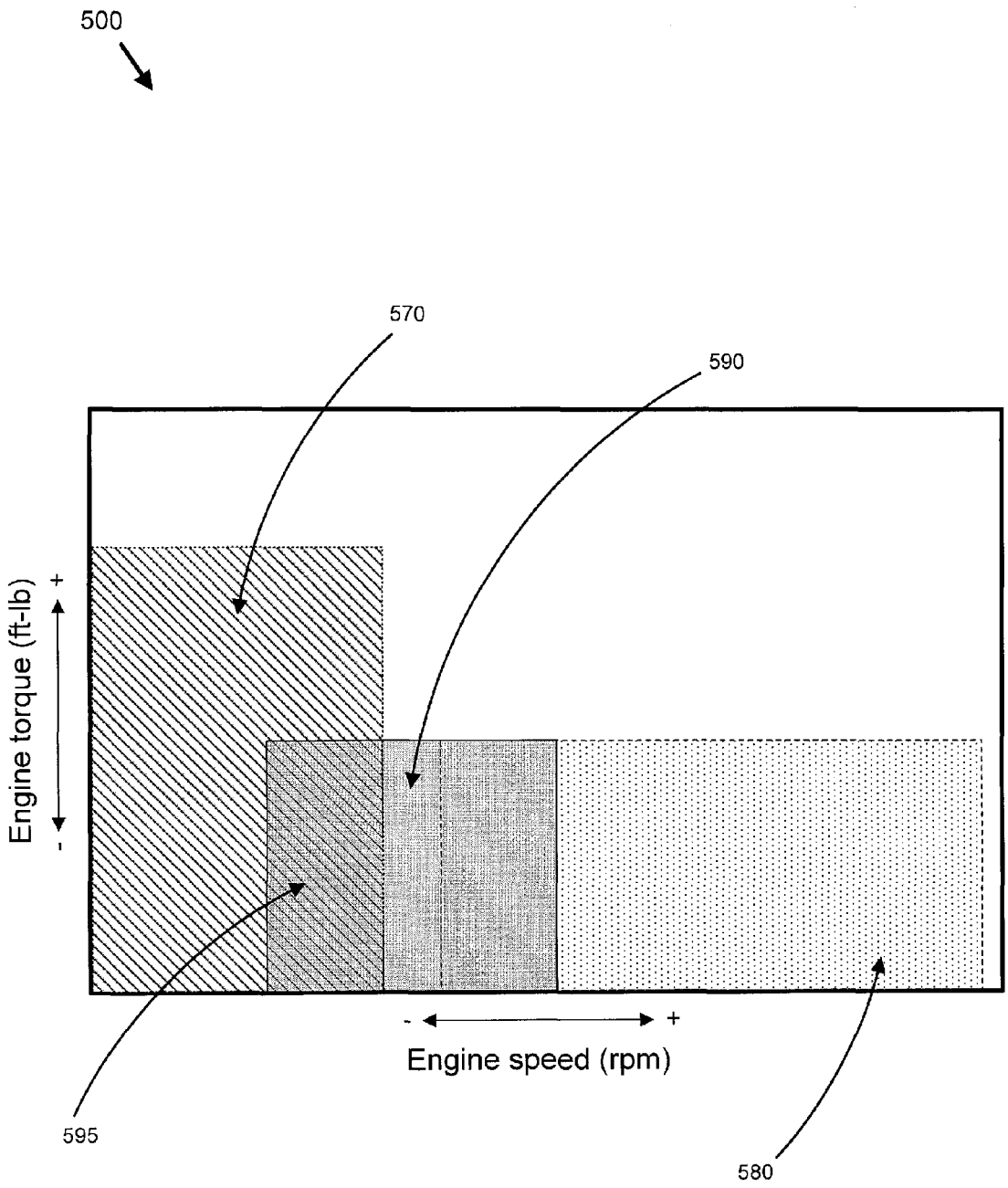
FIG. 5 is a chart showing various engine operating ranges of an exemplary internal combustion engine.

For operating speed and torque combinations within a fourth intermediate engine operating range 595 (e.g., an operating range leading up to, during, and trailing the third transition operating range 590), a regeneration fuel injection strategy developed by the fuel injection thermal management module 415 can be provided to smooth the engine outlet exhaust gas temperature changes during transient engine operating conditions. In other words, a fuel injection strategy can be used in conjunction with the VGT device position strategy and/or the exhaust throttle position strategy to provide better control of the engine outlet exhaust gas temperature during transient and even steady-state engine operations. As shown in FIG. 5, the regeneration fuel injection strategy can be implemented when the engine is operating in the fourth intermediate engine operating range 595.

Based at least partially on the desired filter inlet exhaust gas temperature 425 and desired engine outlet exhaust gas temperature 435 received from the regeneration module 260 and the operating conditions 430 of the engine received from the conditions module 250, the fuel injection thermal management module 415 generates the fuel injection command 460 to the fuel injectors. The fuel injectors 135 respond to the fuel injection command by injecting fuel into the compression chambers according to the fuel injection command. The fuel injection command includes instructions for performing a multiple-injection event corresponding to a desired exhaust gas temperature increase and fuel dilution level limit for each cycle of the engine. In certain instances, the multiple-injection event is represented by the relative timing of a plurality of fuel injections and the quantity or dosage of fuel injected in each of the plurality of fuel injections. Generally, the multiple-injection event is configured to promote fuel spray vaporization by injecting smaller amounts of fuel into the cylinder. More fuel spray vaporization results in less fuel spray impinging on the cylinder wall, which translates into a reduced likelihood of fuel blow-by and a reduced level of fuel dilution compared to conventional thermal management strategies. Additionally, a multiple-injection event extends the combustion process to later crank angle positions compared to a single-injection event. Extending the combustion process to later crank angle positions within a misfire limit provides increased engine exhaust gas temperature using smaller amounts of fuel compared to a single-injection event.

Figure 6:
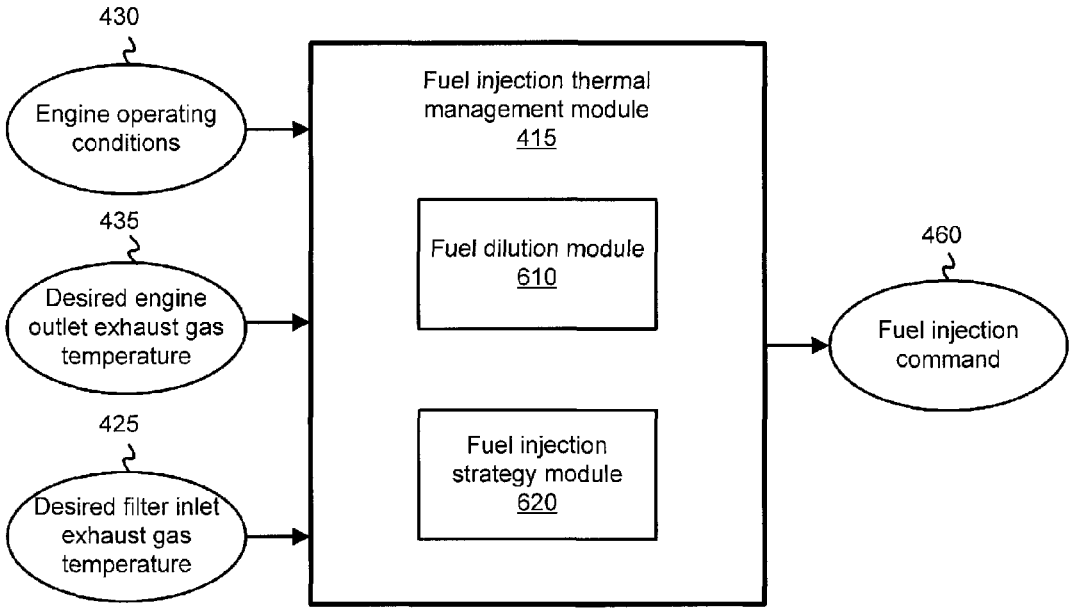
FIG. 6 is a schematic diagram of a fuel injection management module of the engine system thermal management module of FIG. 4.

Referring to FIG. 6, the fuel injection thermal management module 415 includes a fuel dilution module 610 and a fuel injection strategy module 620. The fuel dilution module 610 is configured to determine an acceptable, e.g., maximum, fuel dilution level for the engine 110. The acceptable fuel dilution level for a given engine can be experimentally obtained and integrated into a fuel dilution map comparing fuel dilution values against engine operating conditions and/or cycles. Based at least partially on one or more of the above factors, the fuel dilution module 610 determines the acceptable fuel dilution level of the engine 110.

The fuel injection strategy module 620 is configured to determine a regeneration fuel injection strategy and generate the fuel injection command 460 for communication to the fuel injectors 135. The regeneration fuel injection strategy is at least partially dependent upon the acceptable fuel dilution level determined by the fuel dilution module 610. More specifically, the fuel injection strategy module 620 determines a regeneration fuel injection strategy that will, in conjunction with the VGT device strategy and EGR valve strategy in some embodiments, achieve the desired engine outlet exhaust gas temperature and overall engine performance without exceeding the acceptable fuel dilution level. The regeneration fuel injection strategy is dependent largely upon the operating conditions of the engine 110. For example, the regeneration fuel injection strategy for the engine 110 when operating at lower speed conditions can be a first regeneration fuel injection strategy, and the regeneration fuel injection strategy for the engine when operating at higher speed conditions can be a second regeneration fuel injection strategy different than the first regeneration fuel injection strategy.

The regeneration fuel injection strategies are determined by the fuel injection strategy module 620 on a per cycle basis. In other words, the fuel injection strategy module 620 determines a regeneration fuel injection strategy for each combustion cycle of the engine during a regeneration event initiated by the regeneration module 260 and when the engine in operating in the fourth intermediate operating range 595. The regeneration event typically includes a period for ramping up the temperature of the particulate filter 150, actual regeneration on the particulate filter at predetermined filter temperatures, and any ramping down of the temperature of the particulate filter. In certain implementations, the fuel injection strategies can be determined as described in U.S. patent application Ser. No. 12/111,831, entitled THERMAL MANAGEMENT OF DIESEL PARTICULATE FILTER REGENERATION EVENTS, and filed on Apr. 29, 2008, which is incorporated herein by reference.

Figure 7:
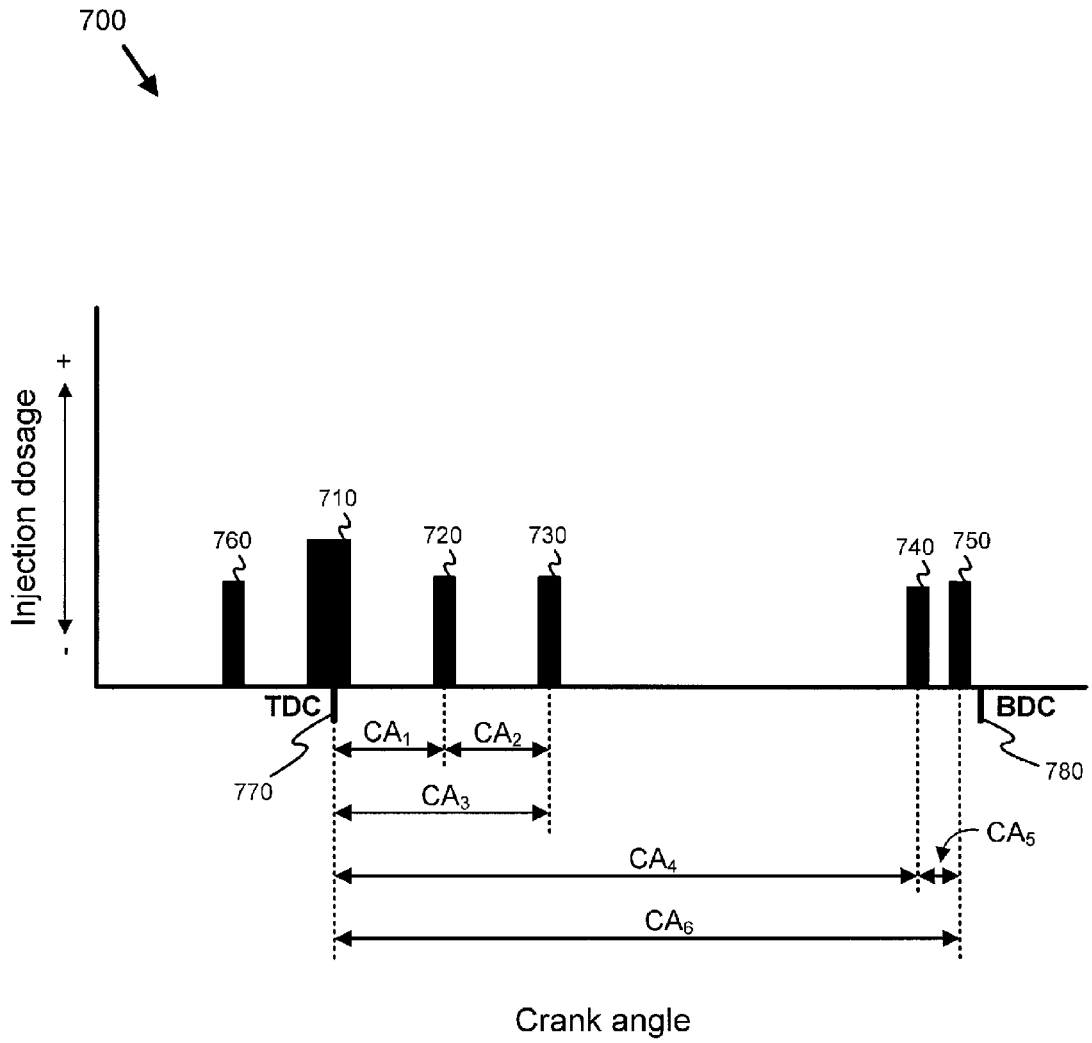
FIG. 7 is a chart showing fuel injections on an engine crank angle line according to one representative embodiment of a regeneration fuel injection strategy.

Referring to FIG. 7, and according to one embodiment, each regeneration fuel injection strategy 700 includes fuel dosage and timing information for a main fuel injection 710 and at least a first heat post-injection 720. In some implementations, each regeneration strategy 700 can also include a second heat post-injection 730. The main fuel injection 710 is the primary injection of the combustion event in the cylinder. The main fuel injection 710 occurs whether a regeneration event is occurring or not. Each of the first and second heat post-injections 720, 730 also participate in the combustion event within the cylinder. More specifically, the first and second heat post-injections 720, 730 occur close enough to the main fuel injection 710 that they are involved in the combustion event driven by the main fuel injection 710. Accordingly, as used herein, heat injections are injections where the injected fuel participates in the combustion event.

In some implementations, the regeneration fuel injection strategy 700 includes one or more non-heat post-injections. The illustrated regeneration fuel injection strategy includes two non-heat post-injections 740, 750. Because the non-heat post-injections 740, 750 occur well after the main fuel injection 710, they do not participate in the combustion event within the cylinder. Generally, the non-heat post-injections 740, 750 are included in the strategy 700 to enrich the exhaust with hydrocarbons and increase the temperature of the exhaust exiting the catalytic component 140 (i.e., increase the catalytic component exhaust gas temperature). Accordingly, as used herein, non-heat injections are injections where the injected fuel does not participate in the combustion event.

The regeneration fuel injection strategy 700 also includes a pilot fuel injection 760 occurring just prior to the main fuel injection 710. The pilot fuel injection 760 drives a smaller combustion event preceding the main combustion event driven by the main fuel injection 710. The smaller combustion event promotes a gradual increase in the temperature within the compression cylinder prior to the rapid temperature increase associated with the main combustion event. Generally, the smaller combustion event reduces potential negative effects of the sudden temperature increase associated with main combustion events, e.g., engine knock and rattles.

As shown in FIG. 7, the timing and the dosage of the fuel injections 710, 720, 730, 740, 750, 760 can vary. Typically, the timing of a fuel injection is represented by the angle of the crank when the fuel is injected into the compression cylinder. Accordingly the timing of a scheduled fuel injection is represented by the angle of the crank when the fuel is scheduled to be injected into the compression cylinder. Further, because a fuel injection event requires a period of time to inject the required dosage of fuel, for convenience, the timing of a fuel injection is associated with the start of the fuel injection event. In FIG. 7, the timing of the fuel injections are compared against a single combustion cycle timeline from a top-dead center (TDC) position 770 of the crank (i.e., when the piston reaches its uppermost point within the cylinder), to a bottom-dead center (BDC) position 780 of the crank (i.e., when the piston reaches its lowermost point within the cylinder), and back to the TDC position. The TDC position 770 is associated with a crank angle of zero-degrees and the BDC position 780 is associated with a crank angle of 180-degrees. As shown, the main fuel injection occurs at TDC, the first heat post-injection 720 occurs at a first crank angle $CA_1$ relative to the TDC position 770, and the second heat post-injection 730 occurs at a second crank angle $CA_2$ relative to the first crank angle $CA_1$ and a third crank angle $CA_3$ relative to the TDC position. The first non-heat post-injection 740 occurs at a fourth crank angle $CA_4$ relative to the TDC position 770 and the second non-heat post-injection 750 occurs at a fifth crank angle $CA_5$ relative to the fourth crank angle $CA_4$ and a sixth crank angle $CA_6$ relative to the TDC position.

In certain implementations, the first crank angle $CA_1$ is an angle between about 8-degrees and about 30-degrees, the second crank angle $CA_2$ is greater than approximately 5-degrees, the third crank angle $CA_3$ is between about 30-degrees and about 63-degrees, the fourth crank angle $CA_4$ is between about 150-degrees and about 170-degrees, the fifth crank angle $CA_5$ is greater than about 2-degrees, and the sixth crank angle $CA_6$ is between about 160-degrees and about 180-degrees.

The dosage of the fuel injections 710, 720, 730, 740, 750, 760 consists of the fuel flow rate and the fuel injection duration. In other words, the duel dosage can be varied by varying either one or more of the fuel flow rate and fuel injection duration. Generally, better performance is achieved by increasing the flow rate and decreasing the fuel injection duration. However, increasing the desired fuel flow rate typically requires an increase in the capability requirements of the fuel injection system. Accordingly, the fuel flow rate and fuel injection duration are dependent upon the fuel injection system.

A regeneration fuel injection strategy 700 having two heat post-injections 720, 730, as opposed to one heat post-injection, provides several advantages. For example, two heat post-injections allow more flexibility in achieving higher exhaust gas temperatures while maintaining acceptable fuel dilution levels. Referring to the chart 800 of FIG. 8, which represents empirical data gathered during testing of a representative engine, the exhaust gas temperatures achieved by a single heat-post injection strategy 810 and a dual heat post-injection strategy 820 are comparable. For example, the temperature achieved with the dual heat post-injection strategy 820 is nearly the same as the temperature achieved with the single heat post-injection strategy. Nevertheless, the fuel dilution encountered when using the dual heat post-injection strategy 820 is significantly lower than the fuel dilution encountered when using the single heat post-injection strategy 810 (e.g., 2.02% versus 6.8%, or only about 30% of the fuel dilution encountered with the single heat post-injection strategy) in order to achieve the same engine outlet exhaust gas temperature. Based on the foregoing, dual heat post-injection strategies provide much lower fuel dilution levels at similar exhaust gas temperatures than single heat post-injection strategies. Therefore, utilizing dual heat post-injection strategies as described herein facilitates large or small changes in the engine exhaust gas temperature without significantly affecting the fuel dilution levels.

Figure 8:
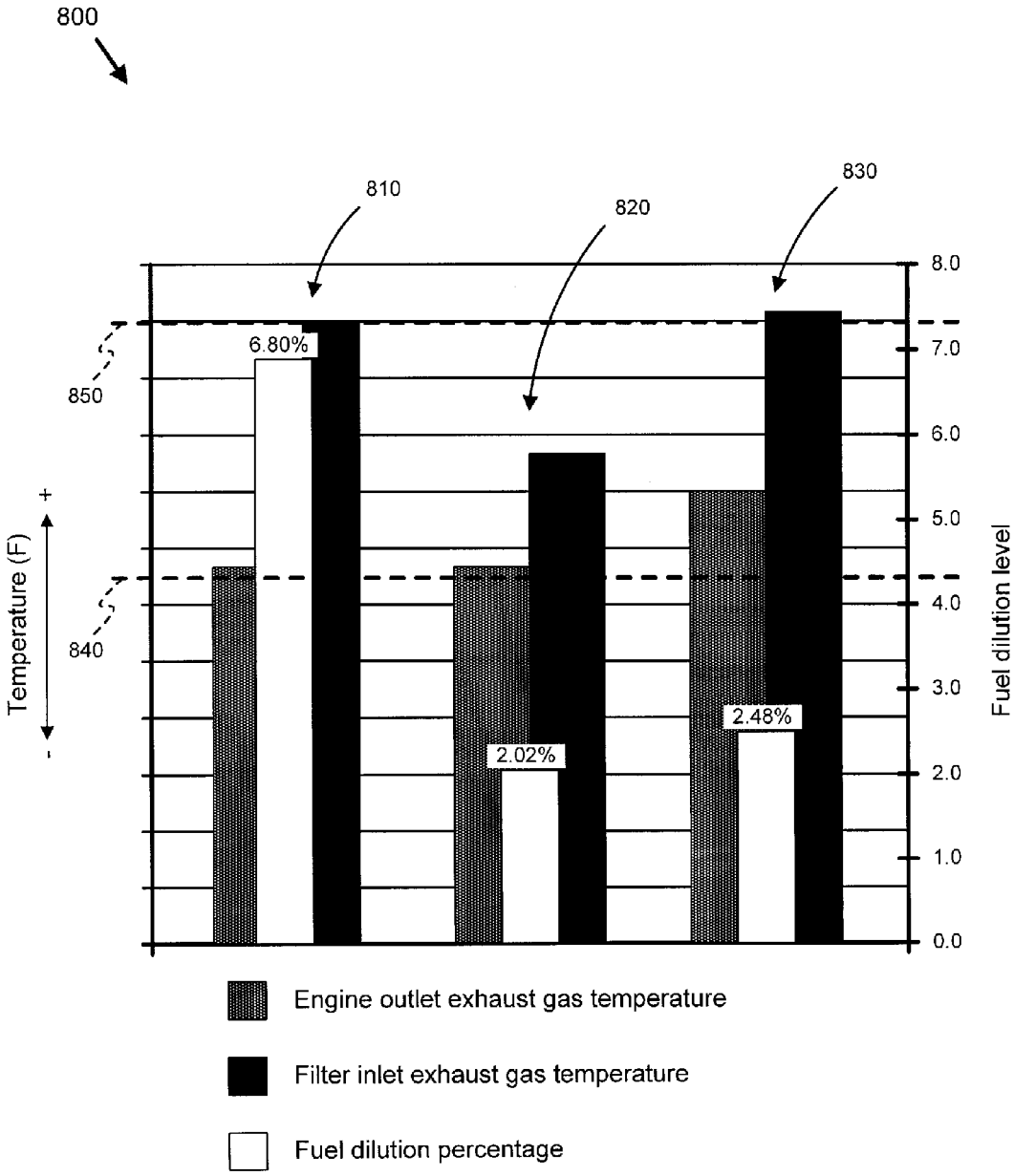
FIG. 8 is a graph comparing engine exhaust gas temperature outputs and fuel dilution levels for a conventional regeneration fuel injection strategy and two regeneration fuel injection strategies according to two embodiments of the present disclosure.

The exhaust gas temperatures, e.g., the engine outlet exhaust gas temperature and filter inlet exhaust gas temperature, achieved with a dual heat post-injection strategy can be increased, without significantly increasing the fuel dilution levels, by adding one or more non-heat post-injections, such as injections 740, 750 of FIG. 7. For example, as shown in FIG. 8, even though the filter inlet exhaust gas temperature achieved using the single and triple post-injection strategies 810, 830 are about the same, two heat post-injections and one non-heat post-injection (e.g., the triple post injection strategy 830) results in an engine outlet exhaust temperature that is higher than the target engine outlet exhaust gas temperature 840 and a 64% lower fuel dilution level than using the single heat post-injection strategy The chart 800 shows exemplary target engine outlet exhaust gas temperature 840 and target particulate filter inlet exhaust gas temperature 850. As shown, the representative single and triple post-injection strategies 810, 830 both achieve the target filter inlet exhaust gas temperature 850, but the triple post-injection strategy 830 does so while producing a significantly lower fuel dilution level. Moreover, while the single, dual, and triple post-injection strategies 810, 820, 830 achieve the target engine outlet exhaust gas temperature 840, the triple post-injection strategy 830 achieves the target engine outlet exhaust gas temperature and target filter inlet exhaust gas temperature with a much lower fuel dilution level, which can promote flexibility in determining fuel injection strategies in view of accomplishing other desired engine operating parameters, such as higher fuel economy and more efficient hydrocarbon conversion in the catalyst component 140.

Regeneration fuel injection strategies having two heat post-injections, such as the regeneration fuel injection strategy 700 shown in FIG. 7, are capable of achieving the same or similar engine exhaust gas temperatures as single heat post-injection strategies, but with lower fuel dilution levels than single heat post-injection strategies for some engine operating conditions. Moreover, regeneration fuel injection strategies employing two heat post-injections are capable of achieving higher engine outlet exhaust gas temperatures than single heat post-injections for other operating conditions. In such operating conditions, single heat post-injections often are not able to achieve a target engine outlet exhaust gas temperature, while the dual heat post-injections are able to achieve the target engine outlet exhaust gas temperature. Further, regeneration fuel injection strategies employing two heat post-injections and one or more non-heat post-injections are capable of achieving higher filter inlet exhaust gas temperatures than dual heat post-injection strategies without non-heat post-injections, but with similar dilution levels as dual heat post-injection strategies without non-heat post-injections.

In addition to VGT device, exhaust throttle, and fuel injection strategies, an air intake throttle strategy can be used to control the engine outlet exhaust gas temperature, fuel dilution level, and engine performance. The air intake throttle strategy is generated by the air intake thermal management module 420 and includes information on the desired position of the air intake throttle relative to the operating range in which the engine is operating. The air intake throttle strategy is represented by the intake throttle command 465, which commands the air intake throttle 115 to actuate into a requested position to allow a desired amount of air to flow into the intake manifold 114.

Like the VGT device 119 and exhaust throttle 134, the position of the air intake throttle 115, and thus the amount of air entering the intake manifold 114, affects the temperature of the exhaust gas generated by the engine. For example, the less air let through the throttle at low engine speeds, generally the higher the engine outlet exhaust gas temperature. The air intake throttle 115 is primarily controlled according to the position of the accelerator pedal. However, the position of the air intake throttle 115 is further controlled by the controller 130 to adjust the temperature of the engine outlet exhaust gas. Generally, the air intake throttle strategy involves selectively reducing the air intake flow via actuation of the throttle 115 within the first engine operating range 570.

In certain implementations, when operating in the first and second engine operating ranges 570, 580 during a regeneration event, the turbocharger management module 405, exhaust throttle thermal management module 410, and air intake thermal management module 420 are in electrical communication and work together to generate a VGT command 450, exhaust throttle command 455, and intake throttle command 465 that cooperatively produce an engine outlet exhaust gas temperature corresponding to the desired filter exhaust gas temperature 425. For example, the VGT device 119 can be open or closed, the exhaust throttle can be positionable in any of various positions between the open and closed positions, and the air intake throttle 115 can be positionable in any of various positions to provide any of various engine outlet exhaust gas temperature increases. Each of the VGT, exhaust throttle, and air intake strategies are configurable to increase the engine outlet temperature a respective amount. The respective exhaust gas temperature increase amounts are combinable with the normal engine outlet exhaust gas temperature to achieve the desired filter inlet exhaust gas temperature.

When the engine is operating in the fourth intermediate engine operating range 595 during a regeneration event, the fuel injection thermal management module 415 is in electrical communication and works together with the turbocharger, exhaust throttle, and air intake thermal management modules 405, 410, 420 according to a first exhaust gas temperature control strategy to generate a VGT command 450, an exhaust throttle command 455, an intake throttle command 465, and a fuel injection command 460 that cooperatively produce an engine outlet exhaust gas temperature corresponding to the desired filter inlet exhaust gas temperature. The commands 450, 455, 465, 460 are dependent upon the desired filter inlet exhaust gas temperature and a smooth transition limit of the VGT device 119. The smooth transition limit of the VGT device 119 is the limitation of VGT change rate due to the engine speed and/or torque changes in which adjustment of the VGT device 119 may yield unpredictable behavior. As discussed above, the regeneration fuel injection strategy represented by the fuel injection command 460 facilitates a smooth transition between the first and second engine operating ranges 570, 580 during transient engine operating conditions. In certain embodiments, such as during operation in the fourth intermediate engine operating range 595, each of the VGT, exhaust throttle, fuel injection, and air intake strategies are configurable to increase the engine outlet temperature a respective amount within the limitations of the VGT position change rate, and the fuel injection strategy is further configurable to increase the catalytic component gas temperature a desired amount. The respective exhaust gas temperature increase amounts and the catalytic component temperature increase amount are combinable with the normal engine outlet exhaust gas temperature to achieve the desired filter inlet exhaust gas temperature.

Figure 9:
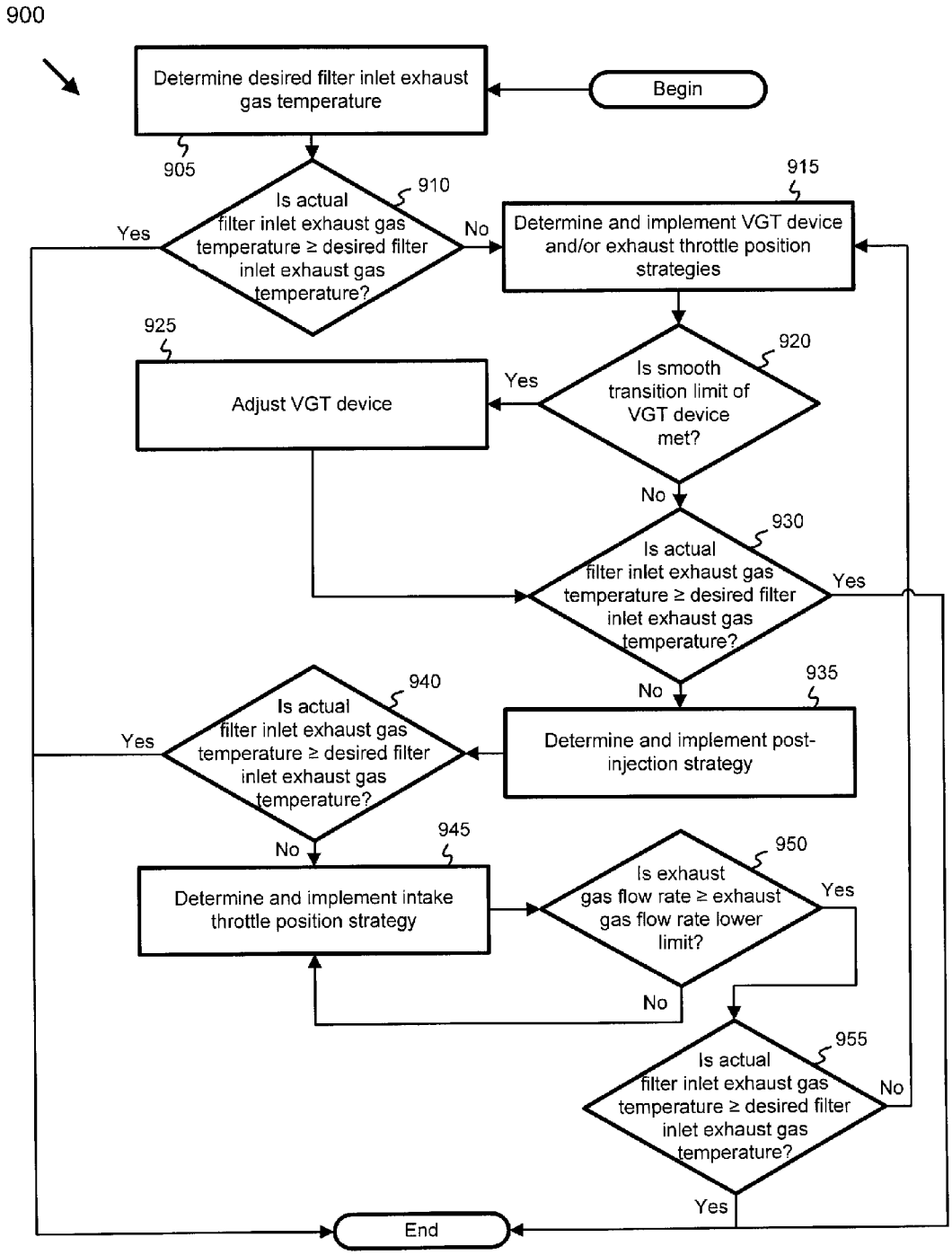
FIG. 9 is a method for controlling engine exhaust gas temperatures of an internal combustion engine during a regeneration event according to one embodiment.

Referring to FIG. 9, in one embodiment, a method 900 for implementing the first exhaust gas temperature control strategy during a regeneration event includes determining 905 a desired filter exhaust gas temperature. The desired filter inlet exhaust gas temperature can be determined by the regeneration module 260 as discussed above. The method 900 proceeds by determining 910 whether the actual filter inlet exhaust gas temperature is greater than or equal to the desired filter inlet exhaust gas temperature 425. The actual filter inlet exhaust gas temperature can be interpreted from an exhaust sensor positioned proximate the inlet to the particulate filter 150. If the actual filter inlet exhaust gas temperature is greater than or equal to the desired filter inlet exhaust gas temperature 425 as determined at 910, then the method 900 ends. However, if the actual filter inlet exhaust gas temperature is less than the desire filter inlet exhaust gas temperature 425, then the method 900 proceeds by determining and implementing 915 VGT device 119 and/or exhaust throttle 134 position strategies. The strategies are represented by a VGT command 450 and an exhaust throttle command 455, respectively, as discussed above with each command corresponding to a desired position of the VGT device and exhaust throttle valve, respectively.

In certain instances, VGT device 119 and exhaust throttle 137 positions for the various engine operating conditions are predetermined based on engine development mapping data, which can be stored in the memory module 310. Alternatively, the VGT device 119 can be adjusted to achieve a desired engine outlet exhaust gas temperature within the VGT smooth transition limit. If the desired engine outlet exhaust gas temperature is not achievable solely by adjusting the VGT device position, then the exhaust throttle position may be adjusted. In the illustrated embodiment, the engine system 100 includes both a VGT device and an exhaust throttle. However, in other embodiments, the engine system may include either a VGT device or an exhaust throttle.

After the position of the VGT device 119 is adjusted, it is determined at 920 whether the new VGT device position results in the smooth transition limit of the VGT device being met. If the smooth transition limit of the VGT device 119 is met, the method 900 adjusts the position of the VGT device such that the smooth transition limit is not met and proceeds to determine whether the actual filter exhaust gas temperature is greater than or the same as the desired filter exhaust gas temperature 425 at 930. If the smooth transition limit of the VGT device 119 is not met at 920, then the method 900 determines whether the actual filter inlet exhaust gas temperature is greater than or the same as the desired filter inlet exhaust gas temperature 425 at 930. If at 930 it is determined that the actual filter inlet exhaust gas temperature is indeed greater than or the same as the desired filter inlet exhaust gas temperature 425, the method 900 ends.

However, if the actual filter inlet exhaust gas temperature is not greater than or the same as the desired filter inlet exhaust gas temperature 425 as determined at 930, then the method 900 continues to determine and implement 935 a post-injection strategy such as described above. After the post-injection strategy is implemented, the method 900 then determines whether the actual filter inlet exhaust gas temperature is greater than or the same as the desired filter inlet exhaust gas temperature 425 as determined at 940. If the actual filter inlet exhaust gas temperature is greater than or the same as the desired filter inlet exhaust gas temperature 425 as determined at 940, the method ends. However, if the actual filter inlet exhaust gas temperature is not greater than or the same as the desired filter inlet exhaust gas temperature as determined at 940, then the method continues to determine and implement an intake throttle position strategy 945 if available. The intake throttle position strategy 945 is represented by an intake throttle command 465 corresponding to a desired position of the intake throttle valve 115.

After the intake throttle position strategy is implemented at 945, the method 900 determines whether the engine outlet exhaust flow rate is greater than or equal to an exhaust flow rate lower limit. The flow rate of exhaust must be higher than a predetermined exhaust flow rate lower limit to effectuate the desired temperature distribution within the particulate filter 150 and avoid damaging or melting the filter due to uncontrolled regeneration caused when the temperature of the filter exceeds a predetermined maximum temperature capacity of the filter substrate material. If the exhaust flow rate is less than the exhaust flow rate lower limit, then the method returns to event 945 to determine and implement a new intake throttle position strategy including an increase in the commanded air intake necessary to achieve or exceed the exhaust flow rate lower limit. Once the exhaust flow rate meets or exceeds the exhaust flow rate lower limit, the method 900 proceeds to determine whether the actual filter inlet exhaust gas temperature is greater than or equal to the desired filter inlet exhaust gas temperature 425 at 955.

If it is determined at 955 that the actual filter inlet exhaust gas temperature is lower than the desired filter inlet exhaust gas temperature 425, then the method 900 returns to event 915 to determine and implement a new VGT device and/or exhaust throttle position strategy, and the method 900 continues as described above.

In other implementations, if it is determined at 955 that the actual filter inlet exhaust gas temperature is lower than the desired filter inlet exhaust gas temperature 425, the method can continue in one of various ways depending on which exhaust gas temperature modifier is preferred. A determination of the preferred exhaust gas temperature modifier can be based on any of various factors, such as, for example, fuel economy, power output, driving conditions, and engine operating conditions.

For example, if using the VGT device 119 or exhaust throttle 134 to increase the exhaust gas temperature is preferred, the method 900 can continue from a negative output at 955 to a VGT device and/or exhaust throttle position continuous loop beginning at event 915. The VGT device and/or exhaust throttle position continuous loop can include events 915, 920, 925, and 930. If at 930, the actual filter inlet exhaust gas temperature is not greater than or equal to the desired filter inlet exhaust gas temperature 425, then instead of continuing to event 935, the method 900 returns to event 915. The continuous loop continues until the actual filter inlet exhaust gas temperature determined at 930 is greater than or equal to the desired filter inlet exhaust gas temperature 425.

Alternatively, although not shown in FIG. 9, if using multiple post-injections to increase the exhaust gas temperature is preferred, the method 900 can continue from a negative output at 955 to a multiple post-injection continuous loop beginning at event 935. The multiple post-injection continuous loop can include events 935 and 940. If at 940, the actual filter inlet exhaust gas temperature is not greater than or equal to the desired filter inlet exhaust gas temperature 425, then instead of continuing to event 945, the method 900 returns to event 930. The continuous loop continues until the actual filter inlet exhaust gas temperature determined at 940 is greater than or equal to the desired filter inlet exhaust gas temperature 425.

Further, although not shown in FIG. 9, if using the position of the air intake throttle 115 to increase the exhaust gas temperature is preferred, the method 900 can continue from a negative output at 955 to an air intake continuous loop beginning at event 945. The air intake continuous loop can include events 945, 950, and 955. If at 955, the actual filter inlet exhaust gas temperature is not greater than or equal to the desired filter inlet exhaust gas temperature 425, then instead of continuing to event 915, the method 900 returns to event 945. The continuous loop continues until the actual filter inlet exhaust gas temperature determined at 955 is greater than or equal to the desired filter inlet exhaust gas temperature 425.

In some embodiments where the fuel dilution level of the engine is a concern, the turbocharger, exhaust throttle, air intake, and fuel injection thermal management modules 405, 410, 420, 415 cooperatively operate according to a first exhaust gas temperature and fuel dilution strategy. According to the first exhaust gas temperature and fuel dilution strategy, the VGT command 450, exhaust throttle valve command 455, intake throttle command 465, and fuel injection command 460 are dependent upon the desired filter inlet exhaust gas temperature 425, a smooth transition limit of the VGT device 119, and a fuel dilution limit of the engine. The generated commands 450, 455, 465, 460 are configured to cooperatively produce an engine outlet exhaust gas temperature corresponding to the desired filter inlet exhaust gas temperature 425 and a fuel dilution level below the fuel dilution limit.

According to one implementation, the methods 900, 1000, 1100 (methods 1000, 1100 described below) can be modified to operate the engine in a low fuel dilution mode if the fuel dilution monitor detects a fuel dilution level above a predetermined high fuel dilution limit. For example, if the fuel dilution monitor detects a fuel dilution level above the high fuel dilution limit, the method 900 can be modified to remove or skip event 935 such that following event 930, the method 900 proceeds directly to event 945. In this manner, the potential increase in fuel dilution levels associated with post-injections can be eliminated to maintain the actual fuel dilution at a level below the high fuel dilution limit.

Figure 10:
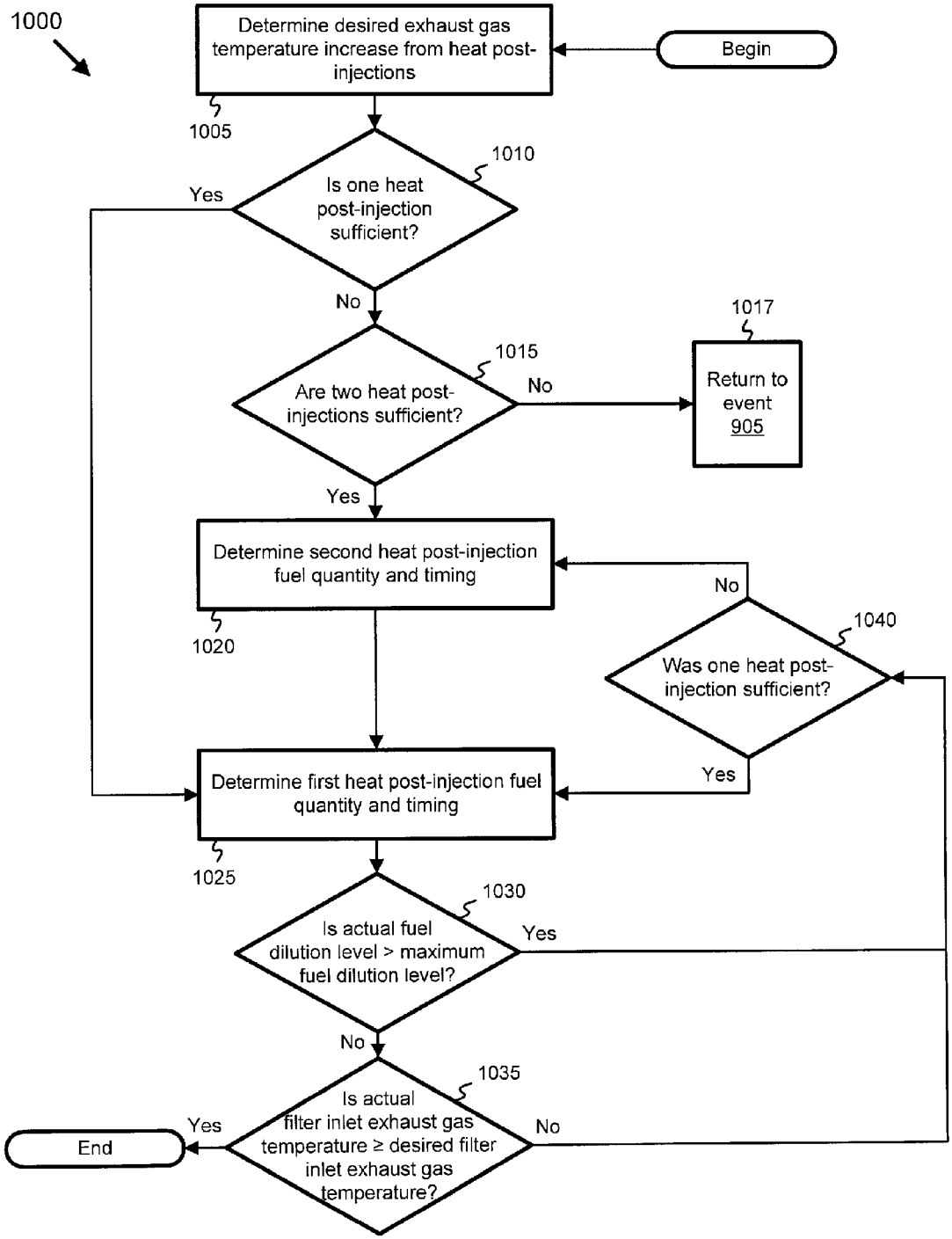
FIG. 10 is a method for determining a heat post-injection fuel injection strategy according to one embodiment.

Referring to FIG. 10, one embodiment of a method 1000 achieving the determining and implementing a post-injection strategy event 935 of method 900 includes determining 1005 a desired exhaust gas temperature increase. The method 1000 continues by determining 1010 whether one heat post-injection will be sufficient for achieving the desired exhaust gas temperature increase. If one heat post-injection is sufficient, the method 1000 continues by determining 1025 the quantity or dosage of fuel and the timing of the post-injection. If one heat post-injection is insufficient, the method continues by determining 1015 whether two heat post-injections will be sufficient for achieving the desired exhaust gas temperature increase. If two heat post-injections are sufficient, the method 1000 continues by determining 1020 the quantity or dosage of fuel and the timing of the second post-injection, and determining 1025 the quantity or dosage of duel and the timing of the first post-injection. However, if two heat post-injections are not sufficient, the method 1000 returns to event 905 of method 900 at 1017. The method 900 attempts to increase the temperature of the engine outlet exhaust gas at events 905 and 915. Therefore, when the method 900 reaches event 935 and the method 1000 is again implemented, the desired exhaust gas temperature increase may be less such that the two, or perhaps one, heat post-injections may now be sufficient for achieving the desired exhaust gas temperature increase.

If one or two heat post-injections are sufficient as determined at 910, 915 and after the injection characteristics of the first and/or second heat post-injections are determined at 1020, 1025, the method 1000 continues by determining 1030 if the actual fuel dilution level is greater than a maximum fuel dilution level of the engine. If the actual fuel dilution level is greater than the maximum fuel dilution level, the method proceeds to event 1040. If it was previously determined at event 1010 that one heat post-injection was sufficient, then the method 1000 returns to event 1025 to modify the injection characteristics of the first heat post-injection only. If it was previously determined at events 1010 and 1015 that two heat post-injections were sufficient, then the method 1000 returns to event 1020 to modify the injection characteristics of the second heat post-injection and then to event 1025 to modify the injection characteristics of the first heat post-injection. If the actual fuel dilution level is less than or equal to the maximum fuel dilution level, then the method 1000 continues by determining 1035 whether the actual filter inlet exhaust gas temperature is greater than or equal to the desired filter inlet exhaust gas temperature 425. If the actual filter inlet exhaust gas temperature is greater than or equal to the desired filter inlet exhaust gas temperature 425, then the method 1000 ends. However, if the actual filter inlet exhaust gas temperature is less than the desired filter inlet exhaust gas temperature 425, then the method returns to event 1020 or event 1025 depending on whether one or heat two post-injections were determined to be sufficient.

In certain implementations, the method 1000 does not include event 1035 such that once the actual fuel dilution level is less than or equal to the maximum fuel dilution level as determined at 1030, the method 1000 ends and the method 800 proceeds to event 840.

Often, the catalytic component 140 may demand a greater increase in the engine outlet exhaust gas temperature to achieve proper oxidation on the catalytic component 140 as well as to ensure that the temperature of the exhaust entering the particulate filter is sufficient to conduct a regeneration event. Therefore, in certain implementations, the multiple post-injection strategy determined and implemented at 835 includes a heat post-injection strategy such as described in method 1000 as well as a non-heat post-injection strategy, such as shown in method 1100 of FIG. 11. The non-heat post-injection strategy, e.g., method 1100, can be performed following completion of the heat post-injection strategy, e.g., method 1000.

Figure 11:
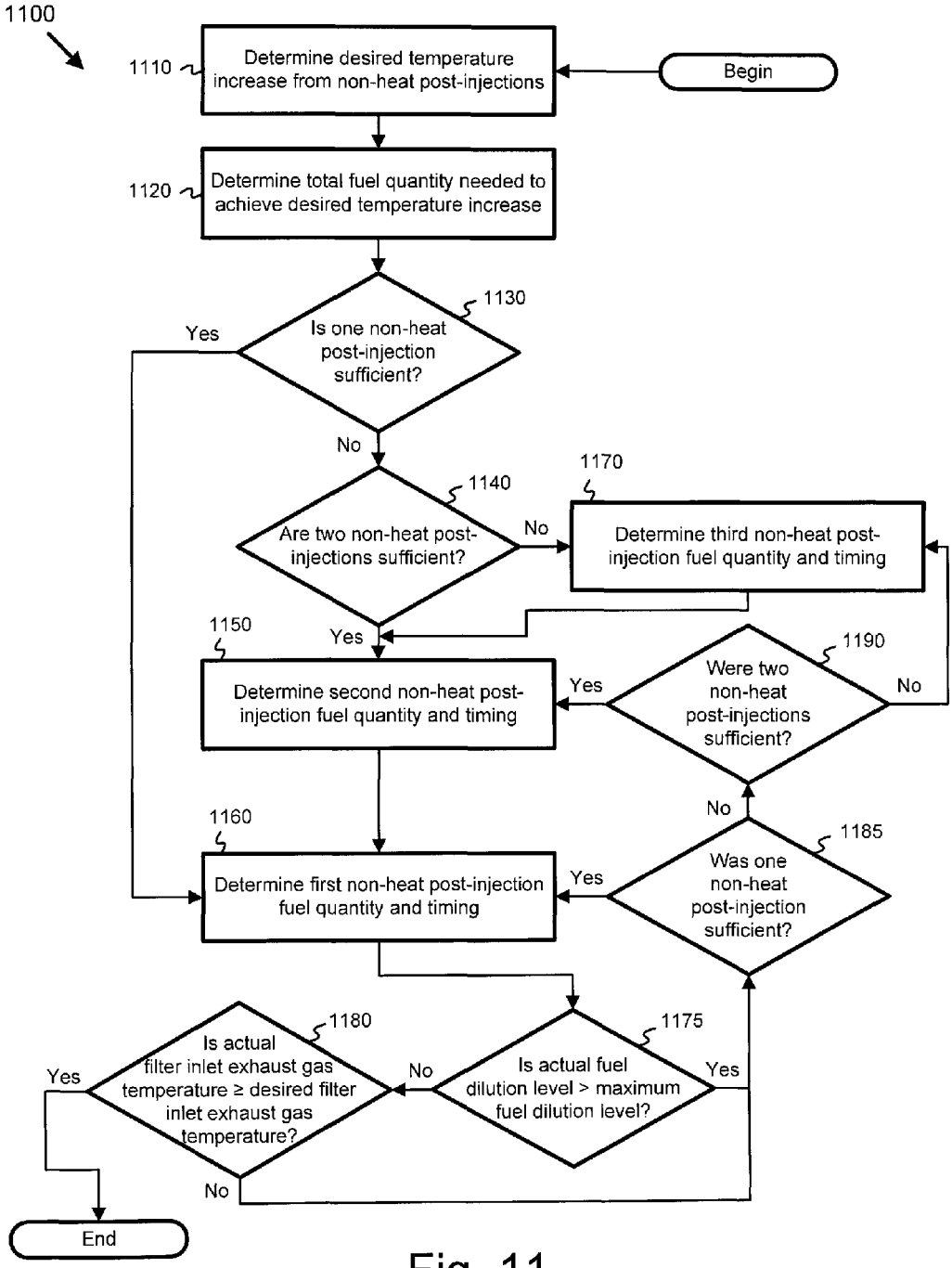
FIG. 11 is a method for determining a non-heat post-injection fuel injection strategy according to one embodiment.

Referring to FIG. 11, method 1100 includes determining 1110 a desired temperature increase in the engine exhaust, which can include an increase in the engine outlet exhaust gas and an increase in the catalytic component outlet gas. As discussed above, such temperature increases are necessary to achieve an engine outlet exhaust gas temperature that will result in a desired catalytic component inlet exhaust gas temperature corresponding to the desired filter inlet exhaust gas temperature 425. Based on the determined desired temperature increase, the method 1100 includes determining 1120 the total fuel quantity necessary to achieve the desired temperature increase. The method 1100 then continues by determining 1130 whether one non-heat post-injection is sufficient to achieve the temperature increase. If one non-heat post-injection is not sufficient, the method 1100 includes determining 1140 whether two non-heat post-injections are sufficient to achieve the temperature increase. If one non-heat post-injection is sufficient, then the method 1100 determines 1160 the fuel quantity and timing of the non-heat post-injection. If two non-heat post-injections are sufficient, the method 1100 determines 1150 fuel quantity and timing of the second of the two non-heat post-injections and then determines 1160 the first of the two non-heat post-injections. If neither one nor two non-heat post-injections are sufficient, the method 1100 proceeds to determine 1170 the fuel quantity and timing of a third non-heat post-injection, and then continues to determine the quantity and timing of the second and first non-heat post-injections at 1150, 1160, respectively. The timing and dosage of the first, second, and third non-heat post-injections can be determined according to a fuel injection control algorithm based on engine mapping data obtained during engine development, and accessible by or stored on the fuel injection strategy module 620. The dosage of the non-heat post-injections can also be determined based on the energy balance and the temperature difference between the engine outlet and the particulate matter filter inlet.

Following event 1160, the method 1100 includes determining 1175 whether the actual fuel dilution level is greater than a maximum fuel dilution level of the engine. If the actual fuel dilution level is greater than the maximum fuel dilution level, then the method proceeds to determine 1185 whether one non-heat post-injection was sufficient. If event 1185 is affirmatively answered, the method 1100 returns to event 1160, and if event 1185 is negatively answered, the method proceeds to determine 1190 whether two non-heat post-injections were sufficient. If event 1190 is affirmatively answered, the method 1100 returns to event 1150, and if event 1190 is negatively answered, the method returns to event 1170.

If the actual fuel dilution level is lower than or equal to the maximum fuel dilution level, then the method proceeds to determine 1180 whether the actual filter inlet exhaust gas temperature is greater than or equal to the desired filter inlet exhaust gas temperature 425 and whether the actual catalytic component inlet exhaust gas temperature is greater than or equal to the desired catalytic component inlet exhaust gas temperature. If event 1180 is answered affirmatively, then the method 1100 ends. However, if the event 1180 is answered negatively, then the method 1100 returns to event 1185.

If event 1185 is affirmatively answered, the method 1100 returns to event 1160, and if event 1185 is negatively answered, the method proceeds to determine 1190 whether two non-heat post-injections were sufficient. If event 1190 is affirmatively answered, the method 1100 returns to event 1150, and if event 1190 is negatively answered, the method returns to event 1170.

Actual fuel dilution levels from methods 1000, 1100 can be interpreted from on-line fuel dilution sensors or monitors coupled to the engine 110. Further, as mentioned above, the actual engine outlet, filter input, and catalytic component inlet exhaust gas temperatures can be interpreted from temperature sensors. In the event one or more of the fuel dilution and temperature sensors are unavailable, predicted values for the actual fuel dilution and actual engine outlet and filter inlet exhaust gas temperatures can be obtained from predetermined look-up tables or maps based on the operating conditions of the engine system 100. Further, in some implementations of method 1100, if an on-line fuel dilution sensor is unavailable, the quantity of each non-heat post-injection can be determined based on a predetermined maximum allowable non-heat post-injection fuel quantity. The predetermined maximum allowable non-heat post-injection fuel quantity can be a function of the timing of the non-heat post-injection, such as whether the post-injection falls within a predetermined timing window.

The schematic flow chart diagrams and method schematic diagrams described above are generally set forth as logical flow chart diagrams. As such, the depicted order and labeled steps are indicative of representative embodiments. Other steps and methods may be conceived that are equivalent in function, logic, or effect to one or more steps, or portions thereof, of the methods illustrated in the schematic diagrams. Additionally, the format and symbols employed are provided to explain the logical steps of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for controlling the temperature of the exhaust of an internal combustion engine for a regeneration event on a particulate matter filter, comprising:

a regeneration module configured to determine a desired particulate matter filter inlet exhaust gas temperature for a regeneration event;

a turbocharger thermal management module configured to determine a variable geometry turbine (VGT) device position strategy;

a fuel injection thermal management module configured to determine a fuel injection strategy;

an air intake throttle thermal management module configured to determine an intake throttle position strategy; and an exhaust throttle thermal management module configured to determine an exhaust throttle valve position strategy;

wherein the VGT device position strategy, the post-injection fuel injection strategy, the intake throttle position strategy, and the exhaust throttle valve position strategy are configured to cooperatively achieve the desired particulate matter filter inlet exhaust gas temperature;

wherein the internal combustion engine is operable in a low speed operating range, a high speed operating range, and a transition operating range between the low and high speed operating ranges;

wherein the exhaust throttle valve position strategy comprises closing the exhaust throttle valve when operating in the low speed operating range, and opening the exhaust throttle valve when operating in the high speed operating range; and wherein the regeneration module, turbocharger thermal management module, fuel injection thermal management module, air intake module, and exhaust throttle thermal management module each comprises one or more of logic hardware and executable code, the executable code stored on one or more non-transitory machine-readable storage media.

2. The apparatus of claim 1, wherein the fuel injection strategy determined by the fuel injection thermal management module is further configured to maintain a fuel dilution level of the engine below a maximum fuel dilution level.

3. The apparatus of claim 1, wherein:

the internal combustion engine is operable in a low speed operating range, a high speed operating range, and a transition operating range between the low and high speed operating ranges; and the VGT device position strategy comprises closing the VGT device when operating in the low speed operating range, opening the VGT device when operating in the high speed operating range, and moving the VGT device between the closed and open position in the transition operating range when the engine is transitioning between the low speed operating range and the high speed operating range.

4. The apparatus of claim 3, wherein:

the engine is operable in an intermediate speed operating range overlapping at least a portion of the low speed operating range, the entire transition operating range, and at least a portion high speed operating range; and the fuel injection strategy comprises at least one heat post-injection when operating in the low and intermediate speed operating range.

5. The apparatus of claim 4, wherein the fuel injection strategy comprises at least one non-heat post-injection.

6. A method for controlling the temperature of the inlet exhaust of a particulate matter filter coupled to an internal combustion engine for a regeneration event on the particulate matter filter, the method comprising:

determining a desired particulate matter filter inlet exhaust gas temperature;

determining and implementing a VGT device position strategy for achieving the desired particulate matter filter inlet exhaust gas temperature;

if the VGT device position strategy does not achieve an actual particulate matter filter inlet exhaust gas temperature approximately equal to or greater than the desired particulate matter filter inlet exhaust gas temperature, determining and implementing a multiple post-injection strategy for achieving the desired particulate matter filter inlet exhaust gas temperature; and if the multiple-post injection strategy does not achieve an actual particulate matter filter inlet exhaust gas temperature approximately equal to or greater than the desired particulate matter filter inlet exhaust gas temperature, determining and implementing an intake throttle position strategy for achieving the desired particulate matter filter inlet exhaust gas temperature.

7. The method of claim 6, further comprising determining and implementing an exhaust throttle valve position strategy for achieving the desired particulate matter filter inlet exhaust gas temperature if the VGT device position strategy does not achieve an actual particulate matter filter inlet exhaust gas temperature approximately equal to or greater than the desired particulate matter filter inlet exhaust gas temperature, wherein the multiple post-injection strategy for achieving the desired particulate matter filter inlet exhaust gas temperature is determined and implemented if the if the exhaust throttle valve position strategy does not achieve an actual particulate matter filter inlet exhaust gas temperature approximately equal to or greater than the desired particulate matter filter inlet exhaust gas temperature.

8. The method of claim 6, further comprising determining whether a smooth transition limit of the VGT device has been met, and if the smooth transition limit of the VGT device has been met, the method further comprising determining and implementing a new VGT device position strategy for achieving the desired particulate matter filter inlet exhaust gas temperature and avoiding an un-smooth transition of the VGT device.

9. The method of claim 6, further comprising determining whether the exhaust flow rate meets or exceeds an exhaust flow rate lower limit after implementation of the intake throttle position, wherein if the exhaust flow rate does not meet or exceed the exhaust flow rate lower limit, determining and implementing a new intake throttle position strategy for achieving the desired particulate matter filter inlet exhaust gas temperature and meeting or exceeding the exhaust flow rate lower limit.

10. The method of claim 6, wherein determining the multiple post-injection strategy comprises:

determining a desired exhaust gas temperature increase from heat post-injections;

determining whether one heat post-injection is sufficient to achieve the desired exhaust gas temperature increase; and if one heat post-injection is not sufficient, determining whether two heat post-injections are sufficient to achieve the desired exhaust gas temperature increase.

11. The method of claim 6, wherein after implementing the multiple post-injection strategy, the method further comprises determining whether an actual fuel dilution level of the engine exceeds a predetermined maximum fuel dilution level of the engine, wherein if the actual fuel dilution level of the engine exceeds the predetermined maximum fuel dilution level of the engine, the method comprises determining and implementing a new multiple post-injection strategy for achieving the desired particulate matter filter inlet exhaust gas temperature and maintaining or reducing the actual fuel dilution level of the engine to a level at or below the maximum fuel dilution level.

12. The method of claim 6, wherein determining the multiple post-injection strategy comprises:

determining a desired filter inlet exhaust gas temperature increase from non-heat post-injections;

determining whether one non-heat post-injection is sufficient to achieve the desired filter inlet exhaust gas temperature increase;

if one non-heat post-injection is sufficient, setting the number of non-heat post-injections of the multiple post-injection strategy to one non-heat post-injection;

if one non-heat post-injection is not sufficient, determining whether two non-heat post-injections are sufficient to achieve the desired filter inlet exhaust gas temperature increase;

if two non-heat post-injections are sufficient, setting the number of non-heat post-injections of the multiple post-injection strategy to two non-heat post-injections; and if two non-heat post-injections are not sufficient, setting the number of non-heat post-injections of the multiple post-injection strategy to three non-heat post-injections.

13. A method for controlling the temperature of the inlet exhaust of a particulate matter filter coupled to an internal combustion engine for a regeneration event on the particulate matter filter, the internal combustion engine being operable in a low speed operating range, high speed operating range, and transition speed operating range between the low and high speed operating ranges, the method comprising:

determining a desired particulate matter filter inlet exhaust gas temperature;

determining a VGT device position strategy configurable to increase the filter inlet exhaust gas temperature during a regeneration event, the VGT device position strategy comprising closing the VGT device during operation of the internal combustion engine in the low speed operating range, opening the VGT device during operation of the internal combustion engine in high speed operating range, and modulating the VGT device between the closed and open positions during operation of the internal combustion engine in the transition speed operating range;

determining a multiple post-injection strategy configurable to increase the filter inlet exhaust gas temperature during a regeneration event, wherein the multiple post-injection strategy is implemented only during operation of the internal combustion engine in the transition speed operating range;

determining an intake throttle position strategy configurable to increase the filter inlet exhaust gas temperature during a regeneration event, the intake throttle position strategy comprising modulating the position of the intake throttle based on whether the internal combustion engine is operating in the low, high, or transition speed operating ranges; and cooperatively implementing the VGT device position strategy, multiple post-injection strategy, and intake throttle position strategy to increase the filter inlet exhaust gas temperature to the desired particulate matter filter inlet exhaust gas temperature.

14. An internal combustion engine system, comprising:

an internal combustion engine generating an engine outlet exhaust, the internal combustion engine being operable in a low speed operating range, high speed operating range, and transition speed operating range between the low and high speed operating ranges, wherein the internal combustion engine comprises a VGT device, an exhaust throttle valve, fuel injectors, and an air intake throttle valve;

a particulate matter filter in exhaust receiving communication with the internal combustion engine; and a controller comprising:

an engine conditions module configured to determine operating conditions of the engine;

a regeneration module configured to determine a desired particulate matter filter inlet exhaust gas temperature for conducting a regeneration event on the particulate matter filter; and an engine system thermal management module configured to determine (i) a VGT device actuation strategy for increasing the temperature of exhaust entering the particulate matter filter a first desired amount, the VGT device actuation strategy comprising closing the VGT device during operation of the internal combustion engine in the low speed operating range, opening the VGT device during operation of the internal combustion engine in high speed operating range, and modulating the VGT device between the closed and open positions during operation of the internal combustion engine in the transition speed operating range; (ii) an exhaust throttle actuation strategy for increasing the temperature of exhaust entering the particulate matter filter a second desired amount, the exhaust throttle actuation strategy comprising modulating the position of the exhaust throttle valve based on whether the internal combustion engine is operating in the low, high, or transition speed operating ranges; (iii) a regeneration fuel injection strategy for increasing the temperature of exhaust entering the particulate matter filter a third desired amount, the regeneration fuel injection strategy comprising controlling the fuel injectors to perform multiple post-injections, wherein the regeneration fuel injection strategy is implemented only during operation of the internal combustion engine in the transition speed operating range; and (iv) an air intake throttle actuation strategy for increasing the temperature of exhaust entering the particulate matter filter a fourth desired amount, the air intake throttle actuation strategy comprising modulating the position of the intake throttle valve based on whether the internal combustion engine is operating in the low, high, or transition speed operating ranges;

wherein the first, second, third, and fourth desired temperature increase amounts are combinable to increase the temperature of exhaust entering the particulate matter filter to a temperature at or above the desired particulate matter filter inlet exhaust gas temperature.

15. The internal combustion engine system of claim 14, wherein:

the engine system thermal management module is configured to determine a fuel dilution threshold level;

the internal combustion engine is operable in a low fuel dilution mode when the fuel dilution level of the engine exceeds the fuel dilution threshold level;

the internal combustion engine is operable in the low fuel dilution mode by setting the third desired temperature increase amount to zero.

16. The internal combustion engine system of claim 14, wherein the first desired temperature increase amount is greater than the third desired temperature increase amount.

17. The internal combustion engine system of claim 14, wherein the third desired temperature increase amount is greater than the first desired temperature increase amount.

18. The internal combustion engine system of claim 14, wherein:

the engine system thermal management module is configured to determine a fuel dilution threshold level; and the regeneration fuel injection strategy is configured to maintain the fuel dilution level of the engine at a level not greater than the fuel dilution threshold level.

19. The internal combustion engine system of claim 14, wherein:

the controller comprises a predetermined map having empirically obtained engine outlet exhaust gas temperatures, particulate matter filter inlet exhaust gas temperatures, and fuel dilution levels for given VGT device positions, exhaust throttle positions, regeneration post-injections, and air intake throttle positions; and the determination of the VGT strategy, exhaust throttle actuation strategy, regeneration fuel injection strategy, and air intake actuation strategy by the engine system thermal management module comprises accessing data from the predetermined map.

20. The method of claim 13, further comprising determining an exhaust throttle valve position strategy configurable to increase the filter inlet exhaust gas temperature during a regeneration event, the exhaust throttle valve position strategy comprising modulating the position of the exhaust throttle valve based on whether the internal combustion engine is operating in the low, high, or transition speed operating ranges, wherein cooperatively implementing comprises cooperatively implementing the VGT device position strategy, exhaust throttle valve position strategy, multiple post-injection strategy, and intake throttle position strategy to increase the filter inlet exhaust gas temperature to the desired particulate matter filter inlet exhaust gas temperature.

* * * * *